US009017773B2

(12) United States Patent
D'Arcy et al.

(10) Patent No.: US 9,017,773 B2
(45) Date of Patent: Apr. 28, 2015

(54) UNIVERSAL SOLUTION FOR GROWING THIN FILMS OF ELECTRICALLY CONDUCTIVE NANOSTRUCTURES

(75) Inventors: Julio M. D'Arcy, Boston, MA (US); Richard B. Kaner, Pacific Palisades, CA (US)

(73) Assignee: The Regents of the University of California, Oakland, CA (US)

( * ) Notice: Subject to any disclaimer, the term of this patent is extended or adjusted under 35 U.S.C. 154(b) by 202 days.

(21) Appl. No.: 13/522,302

(22) PCT Filed: Jan. 13, 2011

(86) PCT No.: PCT/US2011/000071
§ 371 (c)(1),
(2), (4) Date: Oct. 8, 2012

(87) PCT Pub. No.: WO2011/087913
PCT Pub. Date: Jul. 21, 2011

(65) Prior Publication Data

US 2013/0022755 A1 Jan. 24, 2013

Related U.S. Application Data

(60) Provisional application No. 61/295,116, filed on Jan. 14, 2010.

(51) Int. Cl.
*B05D 5/12* (2006.01)
*B05D 3/00* (2006.01)
(Continued)

(52) U.S. Cl.
CPC *H01B 1/128* (2013.01); *B05D 1/18* (2013.01); *H01B 1/127* (2013.01); *Y10S 977/932* (2013.01)

(58) Field of Classification Search
CPC ..... H01B 1/128
USPC ..... 427/535
See application file for complete search history.

(56) References Cited

U.S. PATENT DOCUMENTS 4,504,529 A * 3/1985 Sorensen et al. ..... 430/124.13
5,156,780 A * 10/1992 Kenigsberg et al. ..... 264/424
(Continued)

FOREIGN PATENT DOCUMENTS

JP H07-507000 3/1995
JP 2005-233637 9/2005
(Continued)

OTHER PUBLICATIONS

Matsunaga, M., Whitney, P.J., Surface Changes Brought about by Corona Dischaeatment of Polyethylene Film and the Effect on Subsequent Microbial Colonisation, 2000, Polymer Degradation and Stability, 70, p. 329.*
(Continued)

*Primary Examiner* — Katherine A Bareford
*Assistant Examiner* — Christina McClure
(74) *Attorney, Agent, or Firm* — Foley Hoag LLP

(57) ABSTRACT

A method is described for depositing nanostructures, such as nanostructures of conducting polymers, carbon nanostructures, or combinations thereof. The process comprises placing the nanostructures in a liquid composition comprising an immiscible combination of aqueous phase and an organic phase. The mixture is mixed for a period of time sufficient to form an emulsion and then allowed to stand undisturbed so that the phases are allowed to separate. As a result the nanostructure materials locate at the interface of the forming phases and are uniformly dispersed along that interface. A film of the nanostructure materials will then form on a substrate intersecting the interface, said substrate having been placed in the mixture before the phases are allowed to settle and separate.

25 Claims, 23 Drawing Sheets

(51) Int. Cl.

| | |
|---|---|
| ***B05D 3/10*** | (2006.01) |
| ***B82Y 30/00*** | (2011.01) |
| ***H01B 1/12*** | (2006.01) |
| *B05D 1/18* | (2006.01) |

(56) References Cited

U.S. PATENT DOCUMENTS

| | | | | |
|---|---|---|---|---|
| 5,916,485 | A | 6/1999 | Besenhard et al. | |
| 7,033,639 | B2 * | 4/2006 | Kelly et al. | 427/213.34 |
| 7,455,891 | B2 * | 11/2008 | Kunz et al. | 427/553 |
| 2005/0131139 | A1 * | 6/2005 | Kaner et al. | 524/800 |
| 2005/0238804 | A1 * | 10/2005 | Garbar et al. | 427/180 |
| 2006/0284218 | A1 * | 12/2006 | Kaner et al. | 257/288 |
| 2009/0305055 | A1 | 12/2009 | Shimizu | |
| 2010/0092809 | A1 * | 4/2010 | Drzal et al. | 429/12 |

FOREIGN PATENT DOCUMENTS

| | | |
|---|---|---|
| JP | 2006-192398 | 7/2006 |
| JP | 2008-201635 | 9/2008 |
| JP | 2009-146576 | 7/2009 |
| JP | 2009-295378 | 12/2009 |

OTHER PUBLICATIONS

Cheng et al., "Film climbing of particle-laden interfaces," Colloids and Surfaces A: Physicochemical and Engineering Aspects, 315:275-284 (2008).

Japanese Office Action dated Dec. 2, 2014, from JP 2012-548961.

* cited by examiner

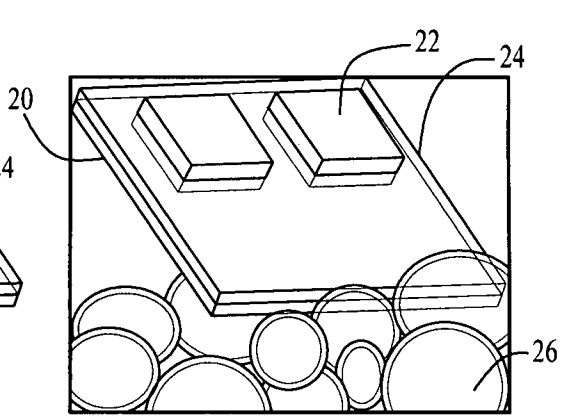
Fig. 54
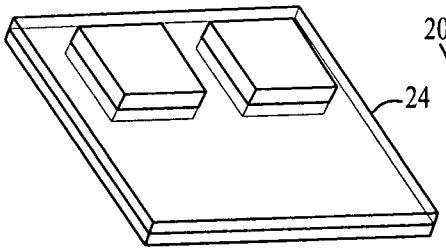
Fig. 55
Fig. 56
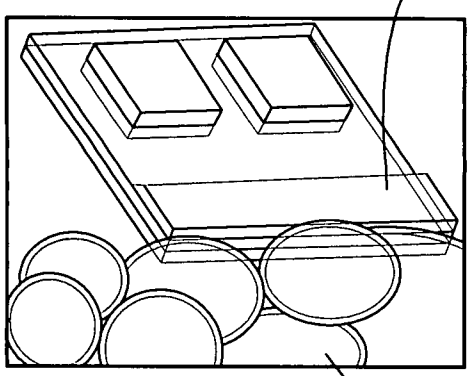
Fig. 57
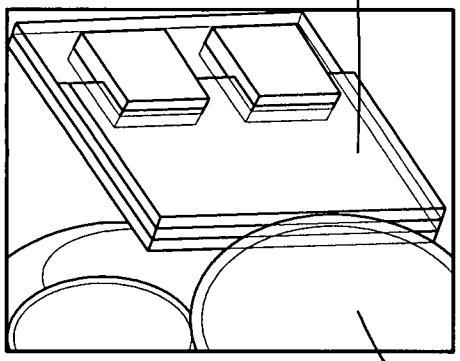
Fig. 58
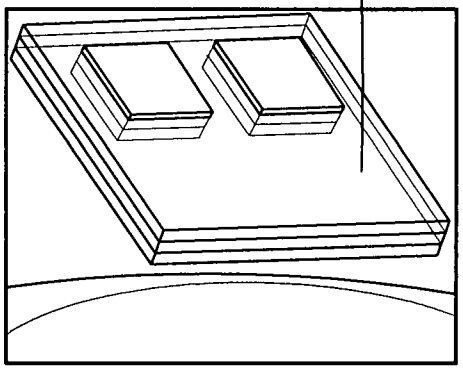
Fig. 59

UNIVERSAL SOLUTION FOR GROWING THIN FILMS OF ELECTRICALLY CONDUCTIVE NANOSTRUCTURES

This is a US National Stage application of International Application PCT/US2011/000071 filed Jan. 13, 2011 and benefit of U.S. Provisional Application 61/295,116 filed Jan. 14, 2010 is claimed.

This invention was made with Government support of Grant No. DMR0507294 awarded by the National Science Foundation. The U.S. government has certain rights in this invention.

The application is directed to a general method of forming thin films from electrically conductive polymers, carbon nanostructures and combinations thereof.

BACKGROUND

Conducting polymers promise inexpensive and flexible materials for various applications, including but not limited to, solar cells, light-emitting diodes and chemiresistor-type detectors (Bravo-Grimaldo, E., Hachey, S., Cameron, C. G. & Freund, M. S. "Metastable Reaction Mixtures For The In Situ Polymerization Of Conducting Polymers". *Macromolecules* 40, 7166-7170 (2007); Zhou, Y. et al. "Investigation on Polymer Anode Design For Flexible Polymer Solar Cells". *Appl. Phys. Lett.* 92, 233308/233301-233308/233303 (2008); Zaumseil, J., Friend, R. H. & Sirringhaus, H. "Spatial Control Of The Recombination Zone In An Ambipolar Light-Emitting Organic Transistor". *Nat. Mater.* 5, 69-74 (2006)). Controllable deposition of homogeneous thin films is essential for the engineering of electronic devices. Despite a myriad of film forming methods reported in the literature including in-situ deposition (Chiou, N.-R., Lu, C., Guan, J., Lee, L. J. & Epstein, A. J. "Growth And Alignment Of Polyaniline Nanofibres With Superhydrophobic, Superhydrophilic And Other Properties". *Nature Nanotech.* 2, 354-357 (2007); Zhang, X., Goux, W. J. & Manohar, S. K. "Synthesis Of Polyaniline Nanofibers By "Nanofiber Seeding". *J. Am. Chem. Soc.* 126, 4502-4503 (2004), electrostatic adsorption in solution (Li, D. & Kaner, R. B. "Processable Stabilizer-Free Polyaniline Nanofiber Aqueous Colloids". *Chem. Commun.* 26, 3286-3288 (2005)), drop-casting (Huang, J., Virji, S., Weiller, B. H. & Kaner, R. B. "Nanostructured Polyaniline Sensors". *Chem.—A Eur. J.* 10, 1314-1319 (2004)), electrochemical deposition (Valaski, R., Canestraro, C. D., Micaroni, L., Mello, R. M. Q. & Roman, L. S. "Organic Photovoltaic Devices Based On Polythiophene Films Electrodeposited On FTO Substrates". *Sol. Energy Mater. Sol. Cells* 91, 684-688 (2007)), spin-coating (Bravo-Grimaldo, ibid.), grafting (Sawall, D. D., Villahermosa, R. M., Lipeles, R. A. & Hopkins, A. R. "Interfacial Polymerization of Polyaniline Nanofibers Grafted To Au Surfaces". *Chem. Mater.* 16, 1606-1608 (2004)), and ink jet printing (Murphy, A. R. & Frechet, J. M. J. "Organic Semiconducting Oligomers For Use In Thin Film Transistors". *Chem. Rev.* 107, 1066-1096 (2007)), there is clearly a need for a simple universal method for reliably depositing electrically conductive films utilizing electrically conductive polymers or conductive nanostructures, or combinations thereof, on substrates.

SUMMARY

A method is described for depositing films of nanostructures, particularly conducting polymers, carbon nanostructures and combinations thereof. The simple and scalable film fabrication technique, which allows reproducible control of thickness and morphological homogeneity on a nanoscale, is an attractive option for industrial applications. Under the proper conditions of volume, doping, and polymer concentration, films consisting of monolayers of conducting polymer nanofibres such as polyaniline and polythiophene, graphene, carbon nanotubes or combinations thereof can be produced in a matter of seconds. A thermodynamically driven solution-based process leads to the growth of transparent thin films of interfacially adsorbed nanofibers. High quality transparent thin films are deposited at ambient conditions on virtually any substrate. Procedures for removing intact films from the substrate are also disclosed. This inexpensive process uses solutions which are recyclable and affords a new technique for coating large substrate areas with conductive materials using a two phase liquid solution comprising an aqueous phase and an organic phase with the polymers.

BRIEF DESCRIPTION OF DRAWINGS

FIG. 7, 1 μm; and FIG. 8—500 nm). FIG. 8 is an enlargement of the area circumscribed by the box in FIG. 7 and FIG. 7 is an enlargement of the area circumscribed by the box in FIG. 6.

FIG. 52—3 μm; FIG. 53—1 μm; FIG. 53 is an enlargement of the area circumscribed in the box in FIG. 52 and FIG. 52 is an enlargement of the area circumscribed by the box in FIG. 51.

FIGS. 54-59 are schematic diagrams of a procedure incorporating features of the invention for forming a film on a substrate.

FIGS. 62-64 are a schematic representation of an automated film formation process.

FIG. 68—30 μm; FIG. 69—10 μm; FIG. 69 is an enlargement of the area circumscribed in the box in FIG. 68 and FIG. 68 is an enlargement of the area circumscribed by the box in FIG. 67).

DETAILED DESCRIPTION

Figures 1, 2, 3:
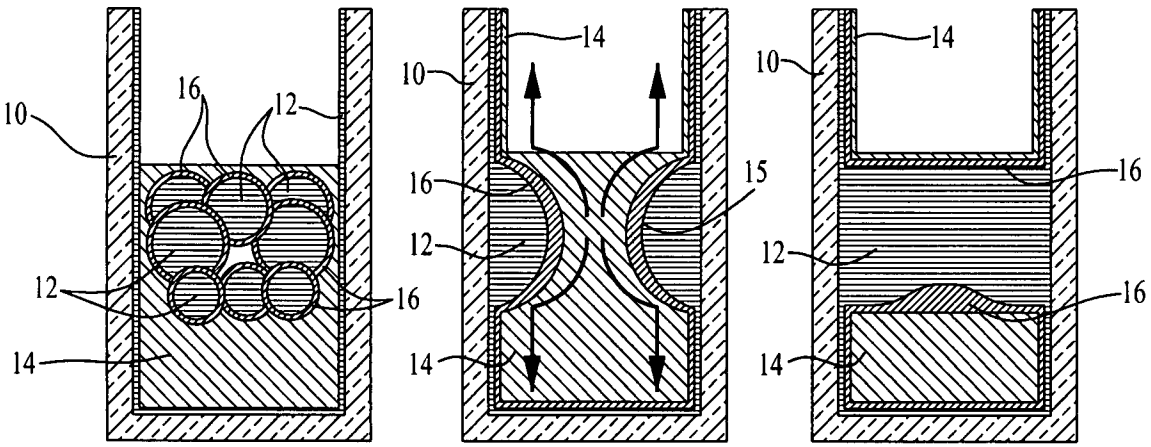
FIG. 1-4 illustrate the mechanism of growth and spreading of a polyaniline nanofiber film with FIGS. 1-3 schematically illustrating the process and FIG. 4 illustrating a time sequence of the film interface formation.

A solution-based method for growing transparent thin films of various nanomaterials, particularly polyaniline and polythiophene nanofibers as well as carbon nanostructure such as graphene sheets and carbon nanotubes on virtually any substrate under ambient conditions is illustrated. Emulsification of two immiscible liquids and polymer nanofibers leads to an interfacial surface tension gradient, viscous flow, and film spreading. Surface tension differentials have previously been used to form inorganic nanoparticle films (Mayya, K. S. & Sastry, M. "A New Technique For The Spontaneous Growth Of Colloidal Nanoparticle Superlattices". *Langmuir* 15, 1902-1904 (1999); Cheng, H.-L. & Velankar, S. S. "Film Climbing Of Particle-Laden Interfaces". *Colloids Surf, A* 315, 275-284 (2008). Binks Bernard, P., Clint John, H., Fletcher Paul, D. I., Lees Timothy, J. G. & Taylor, P. "Particle Film Growth Driven By Foam Bubble Coalescence". *Chem. Commun.* 33, 3531-3533 (2006); Binks, B. P., Clint, J. H., Fletcher, P. D. I., Lees, T. J. G. & Taylor, P.: Growth Of Gold Nanoparticle Films Driven By The Coalescence Of Particle-Stabilized Emulsion Drops". *Langmuir* 22, 4100-4103 (2006)). The films comprise organic, electrically conductive polymers and possess nanoscale order characterized by monolayers of nanofibers. This new film growing technique for conducting polymers can be readily scaled up and the solutions recycled. The morphological homogeneity, reproducible thickness control, and the simplicity of this method for making films provide a unique capability for fabrication of devices which utilize electrical properties of these conductive polymers.

While purifying an aqueous dispersion of one-dimensional polyaniline nanofibers by liquid extraction with chloroform, it was discovered by applicant that a transparent film of polymer is formed on the walls of a separatory funnel. Shaking the solvent mixture removed the film, but left standing, the film rapidly reforms. Based on this discovery, a solution based method to grow films of nanostructured conducting polymers was developed for preparing films for use in various applications including, but not limited to, actuators and sensors, these applications having been previously disclosed in the literature (Jager, E. W. H., Smela, E. & Inganas, O. "Microfabricating Conjugated Polymer Actuators", *Science* 290, 1540-1546 (2000)).

The vigorous agitation of water and a dense oil such as chlorobenzene leads to the formation of water droplets dispersed in an oil phase. The water/oil interface of the droplets serves as an adsorption site for surface active species such as surfactants and solid particles: The surface tension present at the interface is proportionally lowered by the concentration of the adsorbed species, and when the concentration of the absorbed species is distributed unevenly, an interfacial surface tension gradient develops. This in turn causes fluid films to spread over a solid-surface in what is known as the Marangoni effect. This type of directional fluid flow is found in the self-protection mechanisms of living organisms (Goedel, W. A. "A Simple Theory Of Particle-Assisted Wetting". *Europhys. Lett.* 62, 607-613 (2003)) and can be exploited for use in lubrication (Pesach, D. & Marmur, A. "Marangoni Effects In The Spreading Of Liquid Mixtures On A Solid". *Langmuir* 3, 519-524 (1987)), microfluidics (Farahi, R. H., Passian, A., Ferrell, T. L. & Thundat, T. "Microfluidic Manipulation Via Marangoni Forces". *Appl. Phys. Lett.* 85, 4237-4239 (2004)), lab-on-a-chip design (Sarma, T. K. & Chattopadhyay, A. "Visible Spectroscopic Observation Of Controlled Fluid Flow Up Along A Soap Bubble Film From A Pool Of Solution". *J. Phys. Chem. B* 105, 12503-12507 (2001)), and potentially high-density data storage (Cai, Y. & Zhang Newby, B.-m. "Marangoni Flow-Induced Self-Assembly Of Hexagonal And Stripelike Nanoparticle Patterns". *J. Am. Chem. Soc.* 130, 6076-6077 (2008)).

Figure 4:
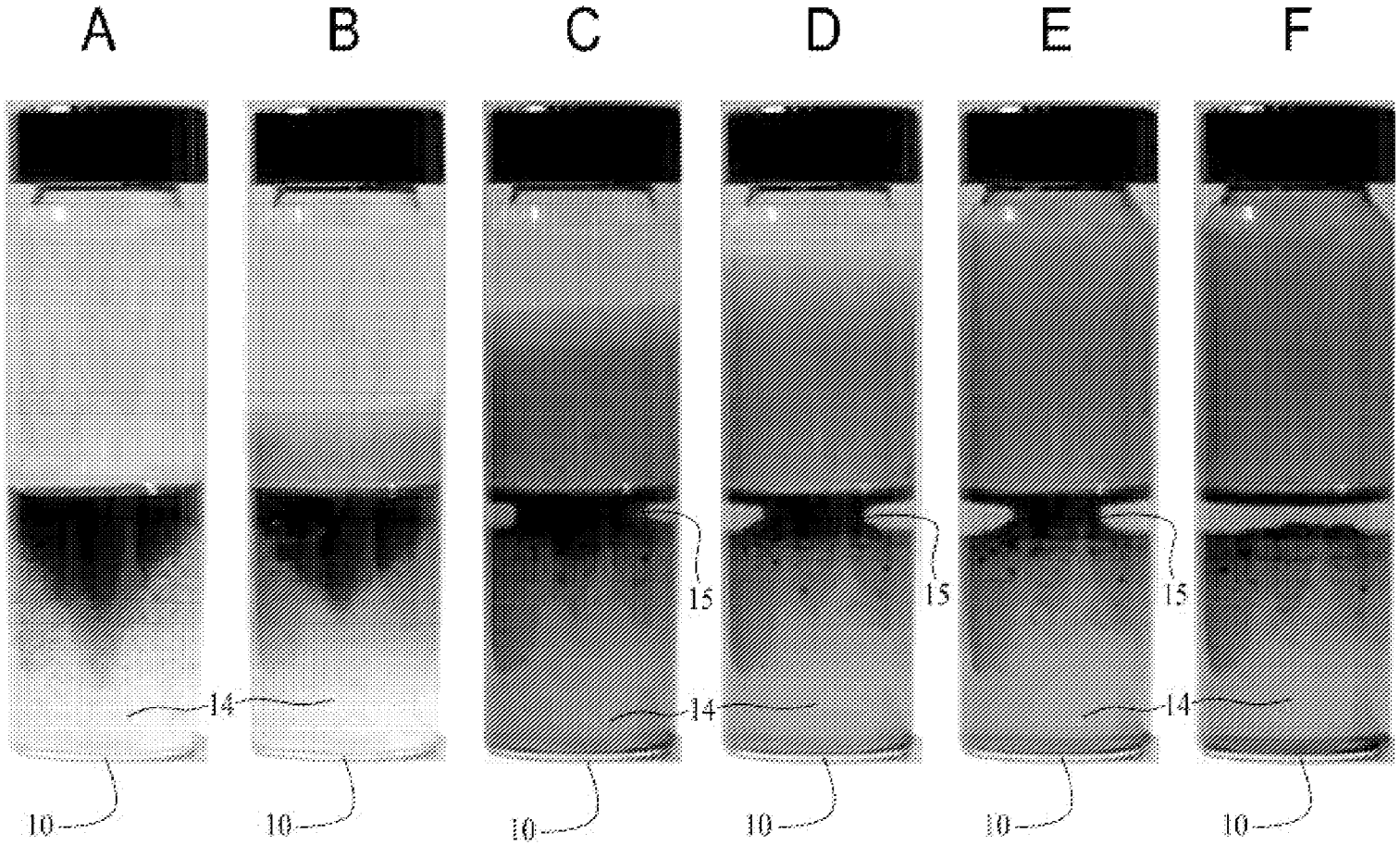

Applicants have developed processes shown schematically in FIGS. 1-3, 54-59 and 62-64 and photographically in FIG. 4, for forming a highly transparent, homogeneous thin film of polymer nanofibers or other nanostructures grown on virtually any substrate. The nanofibers or nanostructures are vigorously mixed with water and a dense oil and then exposing the interface that forms to the surface to be coated. This emulsification process is partly responsible for film growth. Agitation leads to water coating the hydrophilic walls of the container and to aqueous droplets becoming dispersed in the oil phase. Referring to FIGS. 1-3 and the various lettered portions of FIG. 4, water 12, a dense oil 14 and polymer nanofibers 16, for example, are combined in a glass container 10 and vigorously agitated to form an emulsion (FIG. 1, 4A,B). Once mixing is ceased water droplets 12, dispersed in the oil 14 and covered with polymer nanofibers 16 (FIG. 1), rise to the top of the oil phase (FIG. 2, 4C). Droplet coalescence generates a concentration gradient of interfacially adsorbed nanofibers, a water shaped catenoid 15, and directional fluid flow resulting in the spreading of a monolayer of nanofibers 16 up and down the container walls (FIG. 3, 4D,E). The catenoid breaks up into two distinct bulk liquid phases (FIG. 3, 4F) with water 12 on top and oil 14 at the bottom. Nanofibers 16 are deposited at the water/oil interface, adjacent to air and at a separate interface that envelops the bulk oil phase. A polymer reservoir, which forms between the bulk liquid phases and remains after the film growth stops, contains excess nanofibers that can be used to coat additional substrates. Referring to the film growth sequence in FIG. 4, the times are (A) 0 sec; (B) 0.5 sec; (C) 1 sec; (D) 10 sec; (E) 30 sec; (F) 35 sec.

Solid particles such as nanofibers can serve as a stabilizer in what is referred to as a Pickering emulsion by lowering the interfacial surface tension between immiscible liquids (Melle, S., Lask, M. & Fuller, G. G. Pickering Emulsions with controllable stability. *Langmuir* 21, 2158-2162 (2005). Mixing provides the mechanical energy required for solvating the polymer nanofibers with both liquids, thus trapping the nanofibers at the water/oil interface via an adsorption process that is essentially irreversible. Theoretical studies have determined that the energy required to remove adsorbed particles from any interface is much greater than the energy required to interfacially separate them (Ata, S. "Coalescence Of Bubbles Covered By Particles". *Langmuir* 24, 6085-6091 (2008)). Therefore, emulsified nanofibers experience a pulling force and they interfacially spread out. When agitation is stopped, the input of mechanical energy subsides, allowing the water droplets to rise to the top of the oil layer and coalesce. The total interfacial surface area decreases during coalescence expelling oil and nanofibers out from the droplets, producing a spontaneous concentration gradient of irreversibly adsorbed nanofibers, thus creating a Marangoni pressure at the water/oil interface. An interfacial surface tension gradient arises which pulls expelled nanofibers into areas of higher interfacial surface tension, while a film of nanofibers spreads up and down the container walls as a monolayer squeezed between water and oil (FIG. 2, 4C,D,E). Note that there is no film growth on the glass walls that surround the bulk water phase because a water/oil interface is not present (FIG. 3, 4F).

During film growth the water layer assumes the shape of a catenoid with an inner oil channel containing the majority of the nanofibers. Water minimizes its surface free energy by adopting this shape (Lucassen, J., Lucassen-Reynders, E. H., Prins, A. & Sams, P. J. "Capillary Engineering For Zero Gravity". Critical wetting on axisymmetric solid surfaces. *Langmuir* 8, 3093-3098 (1992)). Viscous flow inside the catenoid creates fluid movement both up and down from the thinnest toward the thickest section of the channel (Rey, A. D. "Stability Analysis Of Catenoidal Shaped Liquid Crystalline Polymer Networks". *Macromolecules* 30, 7582-7587 (1997)). Coalescence then thins out the inner channel (FIG. 4 C-E) and eventually leads to the catenoid breaking up and terminating viscous flow. Two distinct bulk phases are established causing the redistribution of nanofibers (FIG. 3, 4F). Water/oil interfaces containing nanofibers are found both adjacent to air and below the bulk water layer. The top interface contains a concentration gradient of nanofibers that continues to drive film growth upward for a few seconds after the catenoid breaks up. This concentration is exploited to coat a glass slide as it is pulled out of the solution. The bottom interface contains a polymer reservoir of nanofibres that is used for the growth of additional films.

The process flow diagrams in FIGS. 54-59 and 62-64 show the mechanism of growth and deposition of a film on a hydrophilic substrate surface 20, 44. A substrate such as $SiO_2$ (FIG. 54) which, in the Figures has a metal electrode 22, is boiled in piranha solution, etched in an oxygen plasma, and submerged in water to induce a homogeneous water layer 24 (FIG. 55). When the wet substrate contacts a Pickering emulsion 26 containing the nano materials (FIG. 56) film growth ensues as a result of droplet 26 coalescence (FIGS. 57-59). A transparent coating 28 of the nano materials spreads in seconds, and is conductively continuous across the entire coated surface area.

Polyaniline nanofiber films were grown on glass slides using different binary mixtures of water and dense halogenated solvents to determine the optimal experimental conditions for film growth. The maximum attainable spreading height was compared against the interfacial surface tension of the binary immiscible mixture used for growing each film. The results indicated that the greater the interfacial tension, the higher the climbing height for an upward spreading film. A larger interfacial surface tension pulls on the nanofibers with a stronger force than a smaller one, and allows a film to climb up the substrate against gravity for a longer time thus leading to greater spreading heights. In one comparison, nanofiber films climbed highest when water and carbon tetrachloride (interfacial surface tension of 45 dynes/cm) were used, followed by water and chloroform (32.8 dynes/cm), and lastly by water and methylene chloride (28.3 dynes/cm). Film growth is driven by minimization of the total interfacial surface free energy of the system (Chengara, A., Nikolov Alex, D., Wasan Darsh, T., Trokhymchuk, A. & Henderson, D. "Spreading Of Nanofluids Driven By The Structural Disjoining Pressure Gradient". *J. Colloid Interface Sci.* 280, 192-201 (2004)).

Dimensions and materials of both containers and substrates were studied to determine how their properties affected film growth. It was found that larger diameter containers (for example from about 2.0 to about 10.0 inches in diameter) offer a greater interfacial surface area between the two liquids thus leading to the formation of a large number of bubbles and highly energetic coalescence, multiple catenoids, and fast rates of film growth. While fast film production may be convenient, with larger diameter containers that the coverage area of an upward climbing film is smaller than in containers possessing narrower diameters (for example from about 0.5 to about 2.0 inches in diameter). Hydrophobic surfaces can also be used as substrates for film growth by first activating the surface for example by using an argon-oxygen plasma.

Figure 5:
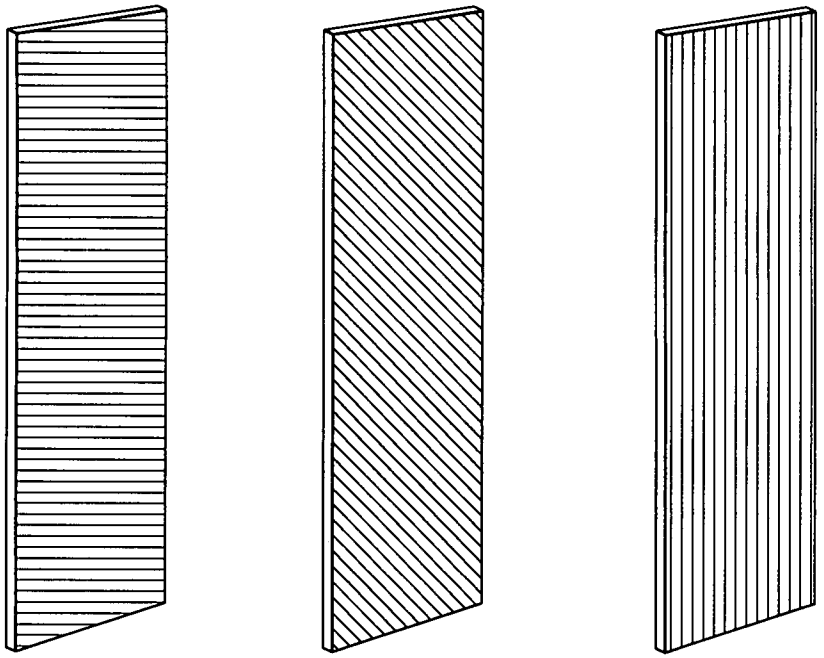
FIG. 5 is a photograph showing three resultant thin transparent films collected on glass microscope slides with the left slide comprising a conducting polymer film of $Cl^-$ doped polythiophene nanofibers (cross-hatched to represent red in color), the middle slide showing a doped polyaniline nanofiber film (cross-hatched to represent green in color) and the right slide showing a dedoped polyaniline nanofiber film (cross-hatched to represent blue in color).

Transparent thin films of conducting polymer nanofibers can be fabricated in various colors. FIG. 5 (cross-hatched to indicate color) displayed films of polyaniline and polythiophene on glass slides. From left to right the films are red chloride doped polythiophene, green perchloric acid doped polyaniline and blue dedoped polyaniline. The films have an excellent light transmittance, particularly the perchloric acid doped polyaniline film, which has a light transmittance greater than 60%. Polyaniline films were grown using an aqueous dispersion of para-toluene sulfonic acid (p-TSA) doped nanofibers and chloroform. The films were then exposed to either base or acid vapors in order to dedope or further dope the film, the film being blue or green, respectively.

Figures 6, 7, 8:
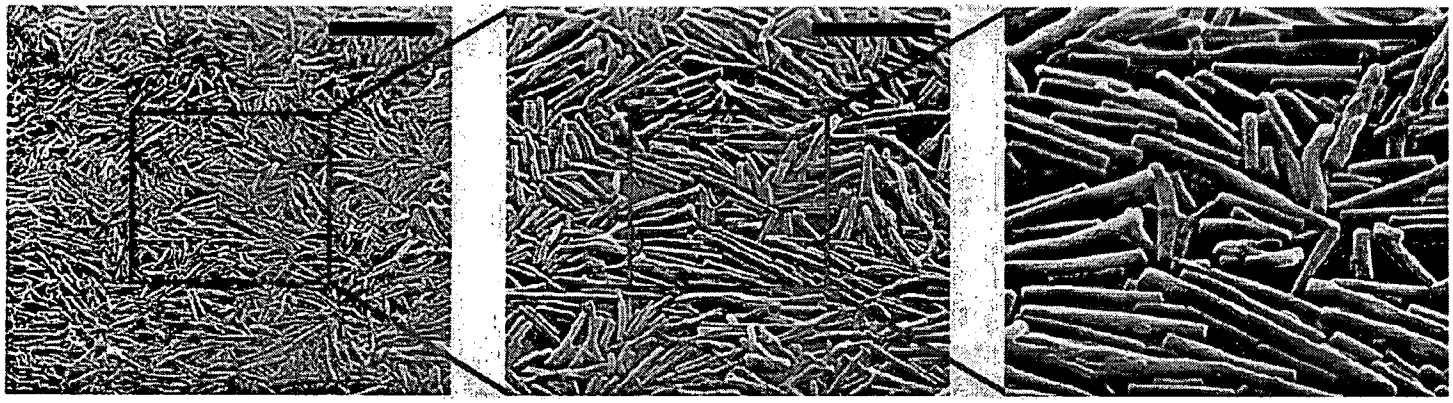
FIGS. 6-8 are SEM images of a thin film of polyaniline nanofibers collected on a glass substrate shown at increasing magnifications (scale bar, FIG. 6—2 μm.

Molecular interactions between the free surface energy of an interfacially adsorbed nanofiber and the substrate can dictate film morphology (Bestehorn, M., Pototsky, A. & Thiele, U. "3D Large Scale Marangoni Convection In Liquid Films". *Eur. Phys. J. B* 33, 457-467 (2003)). Perchloric acid doped polyaniline forms a film with an average thickness of a single nanofiber, shown in FIGS. 6-8. This series of SEM images (tilted at a 52° angle) are characteristic of a $HClO_4$ partially dedoped polyaniline nanofiber film that was grown using chloroform. The nanoscale morphology consists essentially of a single layer of nanofibers shown at increasing magnifications, the scale bar in FIGS. 6-8 representing (a) 2 μm; (b) 1 μm; (c) 500 nm, respectively. FIG. 8 is an enlargement of the area circumscribed by the box in FIG. 7 and FIG. 7 is an enlargement of the area circumscribed by the box in FIG. 6. This occurs because the nanofibers are interfacially extruded when sandwiched between a layer of oil and a layer of water. If films are dried slowly then capillary forces can induce order. This is demonstrated in FIG. 8 where partially dedoped nanofibers orient themselves side-by-side. Single monolayer films can also be created using dopants such as para-toluene sulfonic acid or camphor sulfonic acid.

Figure 10:
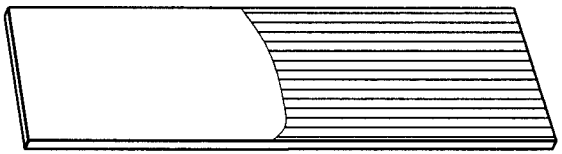
FIGS. 9 and 10 are schematic representations of glass slides illustrating the redox switching of polyaniline nanofibers from an oxidized film (the cross-hatched area in FIG. 9 which is green) to a reduced film (the cross-hatched area in FIG. 10 which is blue) state.
Figure 9:
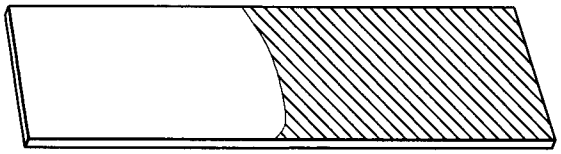
Figure 11:
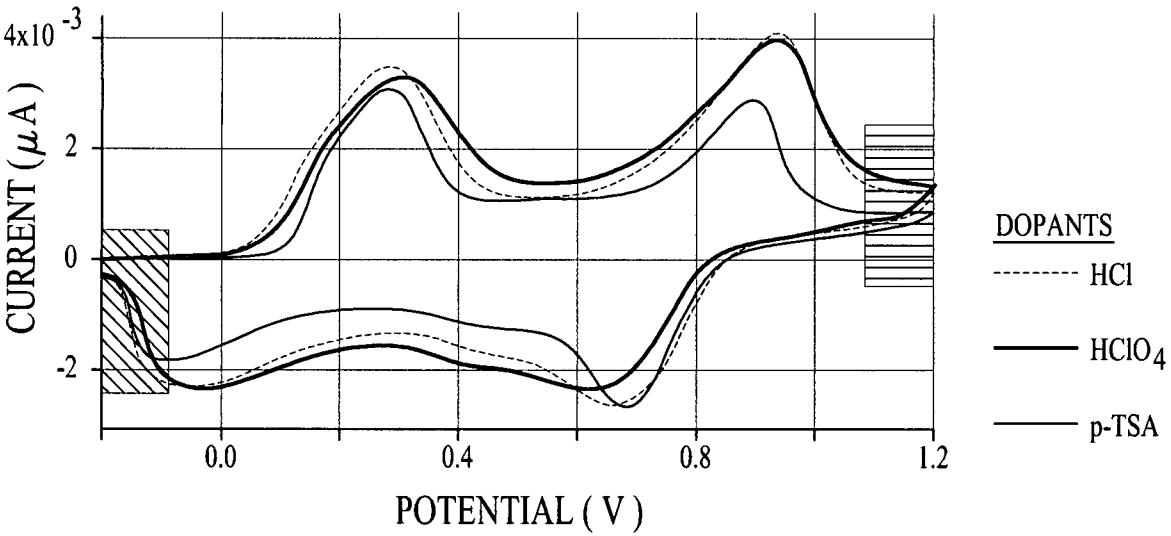
FIG. 11 graphically illustrates the change shown in FIGS. 9-10, the cross-hatched areas corresponding to the like designated areas of FIGS. 9 and 10.

The electrochemical behavior of polyaniline nanofiber films was characterized using cyclic voltammetry (CV), as shown in FIG. 11. Hydrochloric acid, perchloric acid and para-toluene sulfonic acid doped polyaniline films all show two reduction peaks at 0.25 V and 0.95 V and their corresponding oxidation peaks at −0.15 V and 0.68 V. These cyclic voltammograms indicate an emeraldine oxidation state for polyaniline (Pruneanu, S., Veress, E., Marian, I. & Oniciu, L. "Characterization Of Polyaniline By Cyclic Voltammetry And UV-V Is Absorption Spectroscopy". *J. Mater. Sci.* 34, 2733-2739 (1999)). Switching from the green doped form of emeraldine polyaniline (the crosshatched area of FIG. 9) to the blue dedoped form represented in FIG. 10 by the different cross-hatched right hand portion. These nanofiber films are transparent, robust and capable of handling multiple cycles of CV. Only the area of the electrode immersed in the electrolyte (the right portion of the slides in FIGS. 9 and 10) changes color as the direction of the potential is switched. The transparency of the film grown on ITO can be demonstrated by how clearly an image can be viewed through the film. The emeraldine form of a polyaniline nanofiber film, as shown in FIG. 9, was dipped halfway into an electrolyte and electrochemically oxidized to a doped (which is colored green) salt state. The graph (FIG. 11) displays CV curves of polyaniline nanofibers doped with hydrochloric acid (HCl), perchloric acid ($HClO_4$) and para-toluene sulfonic acid (p-TSA). An electrochromic transition is schematically represented in FIG. 10; the polyaniline nanofiber film of FIG. 9 is reduced and the portion of the FIG. 9 transparent green electrode immersed in solution turns blue.

Figure 12:
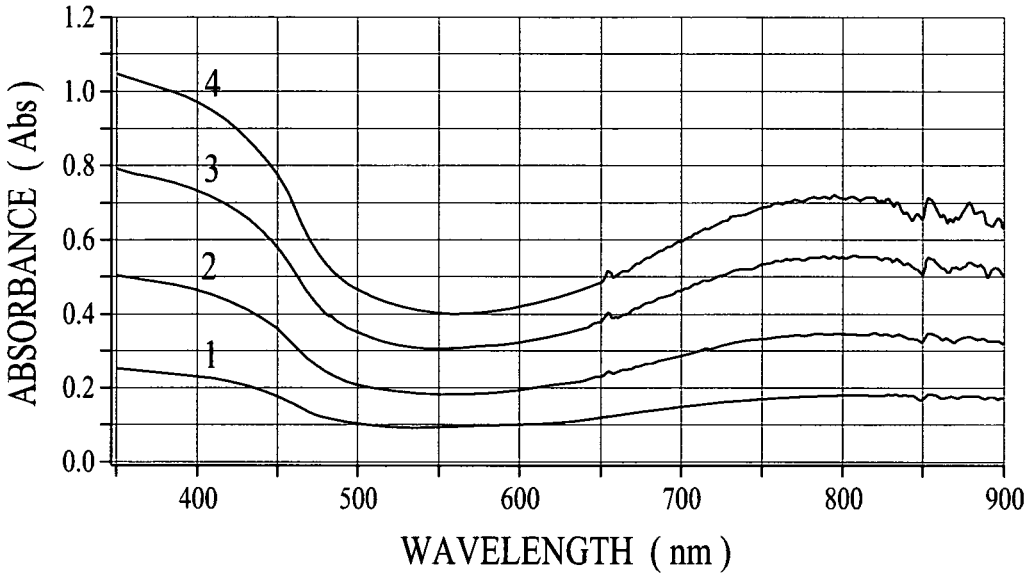
FIGS. 12 and 13 illustrate thickness control during film formation monitored by absorbance UV-vis spectroscopy.

The thickness of films produced by Marangoni flow can be controlled by sequential deposition of layers of doped polyaniline nanofiber films (FIG. 12). In FIG. 12 each of the 4 subsequent layers of a p-TSA doped polyaniline nanofiber film grown on glass can be observed as a result of their incremental increase (~0.2 units) in absorption. The UV-vis spectra (FIG. 13) show that every new layer produces an optical density of approximately 0.2 absorbance units. Each layer of film was allowed to dry for 30 min at ambient conditions before collecting a spectrum. The UV-Vis absorption of polythiophene (FIG. 13) obtained for a film sampled at different heights shows the expected absorption peaks (Patil, A. O., Heeger, A. J. & Wudl, F. "Optical Properties Of Conducting Polymers". *Chem. Rev.* 88, 183-200 (1988)). Film thickness can be controlled by the angle at which the film is grown because the mass of polymer deposited varies inversely with the film height. Therefore, the optical density decreases as the film climbs up the substrate. This demonstrates the ability to control the film thickness via a concentration gradient.

Figure 13:
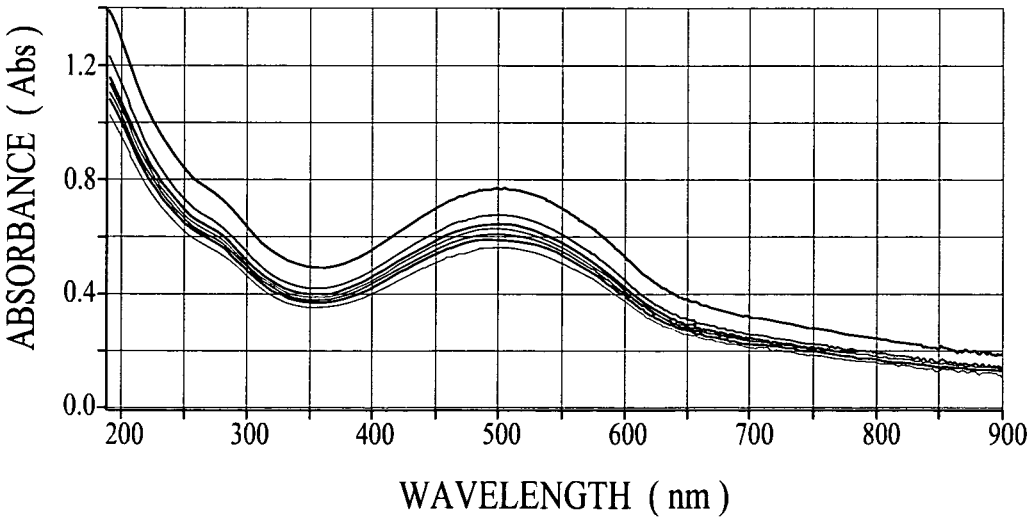
Figure 14:
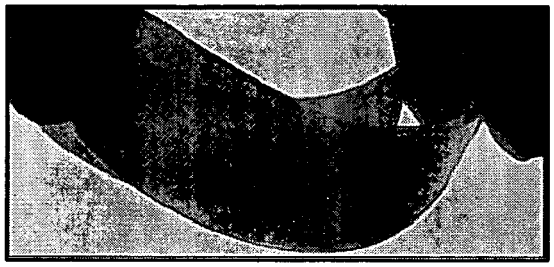
FIG. 14 shows the flexible nature of the film graphically illustrated in FIG. 13.
Figure 15:
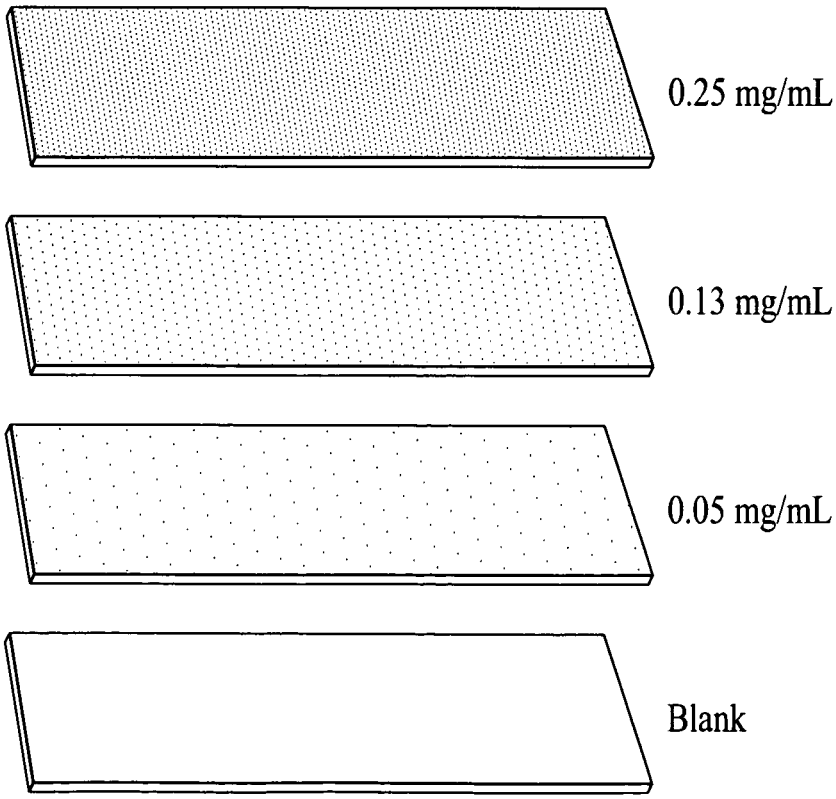
FIG. 15 shows three graphene films prepared from 0.25 mg/ml, 0.13 mg/ml and 0.05 mg/ml graphene dispersions in hydrazine applied to a glass slide. A linear relationship is present between the amount of material deposited on the substrate and the concentration of the solids, represented by differences in density (shown in the Figure by differences in stippling) in the dispersion used for growing a film.

FIG. 13 shows a series of spectra collected at different heights along a polythiophene nanofiber film grown at a 60° angle, demonstrating that optical density can be controlled by the angle of film growth. FIG. 14 shows that a polythiophene nanofiber film grown at a 60° angle on a plastic substrate of ITO-polyethylene terephthalate, is flexible, as demonstrated by applying light pressure (the darker portions at the right and left edge of the insert are the gloved finger tips of the individual flexing the film).

Several examples set forth below describe procedures for the formation of the conductive films, said procedures and resultant products incorporating features of the invention. Reference is made herein to "sonication" which involved placing the substrate or mixture contained in a vessel into an ultrasonic bath filled with water and operating at 60 Hz or alternatively, placing an ultrasonic horn in the vessel containing the mixture.

Substrate Surface Treatment:

Glass. A pre-cleaned 75 mm×25 mm×1 mm microscope glass slide (Corning 2947) was used as a substrate. It was cleaned with isopropyl alcohol and dried with compressed air prior to film collection. Further surface treatment was carried out using: a) sonicating in water for 30 min, b) alternating between boiling in nitric acid and water, or c) via oxygen plasma treatment for 5 minutes.

Quartz. A 75 mm×25 mm×1 mm substrate (QSI Quartz Scientific) was treated using the methods described above for glass or by successive boiling in chromic acid and DI water, followed by oven drying (400° C. for 1 hr).

Silicon. Si substrate was sonicated in isopropyl alcohol (30 min) and then gently scrubbed with a wipe (Kimtech), followed by oxygen plasma treatment for 5 minutes.

ITO-Glass. Indium tin oxide (ITO) coated on glass microscope slides obtained from Nanocs Inc. were cleaned by gently rubbing with a wipe containing isopropyl alcohol, followed by sonication in water for 30 min and/or oxygen plasma treatment for 5 minutes.

ITO-Polyethylene terephthalate. A PET substrate (CP-Films Inc.) was sized to fit snugly inside a 60 ml polypropylene tube. The substrate surface was treated using oxygen plasma for 3 minutes prior to film growth.

These substrate surface treatments are examples and are not intended to limit the scope of surface treated materials. One skilled in the art on the teaching herein can substitute other surface treatments or other substrate materials suitably treated for use in the methods described herein.

NANOFIBERS

Example 1

Polythiophene Nanofiber Synthesis

The process for making polythiophene nanofibers is reported in the literature (Tran, H. D., Wang, Y., D'Arcy, J. M. & Kaner, R. B. "Toward An Understanding Of The Formation Of Conducting Polymer Nanofibers". *ACS Nano* 2, 1841-1848 (2008).). The procedure involves preparing two solutions, namely 1) $FeCl_3$ (0.333 g, $2.1\times10^{-3}$ mol) dissolved in 10 ml of acetonitrile and 2) thiophene (0.133 ml, $1.74\times10^{-3}$ mol) and terthiophene (0.0065 g, $2.61\times10^{-5}$ mol) dissolved in 10 ml of 1,2-dichlorobenzene. These two solutions were combined and mixed for 10 sec and allowed to stand undisturbed for 7 days. The reaction solution was then purified by using centrifugation.

Example 2

Polythiophene Nanofiber Film Growth

Polythiophene conducting polymer nanofibers from Example 1 was formed into an interfacial film using a binary immiscible solution comprised of a smaller aqueous phase (from about 0.2 ml to about 5.0 ml, preferably about 1.5 ml) and a larger organic layer (from about 5.0 ml to about 30.0 ml, preferably about 18 ml) resulting in a aqueous/organic ratio of about 1/10-1/20 preferably about 1/12. This asymmetrical volume distribution leads to Marangoni flow. As an example, a 75 mm×25 mm×1 mm glass slide was coated with polythiophene nanofibers as follows: The slide was placed in a 60 ml polypropylene tube (BD Falcon™ conical tube) 1 ml of a nanofiber dispersion in acetonitrile (2 g/L) 0.6 ml of DI water and 10 ml of chlorobenzene were added to the tube. After vigorous shaking, the polypropylene container was turned horizontally (longer walls parallel to the floor) and then rotated until the slide was standing upright with its longer edges parallel to the floor. Rotating the container to establish this slide orientation affords a shorter climbing distance for the spreading polymer film to cover the entire substrate, therefore high aspect ratio substrates can also be completely covered. Periodic tapping of the container during film growth enhances the rate of bubble coalescence and promotes film growth. After the film was formed, the slides were removed and the films were dried slowly in an organic vapor atmosphere.

Example 3

Polyaniline Nanofiber Synthesis

Polyaniline nanofibers were prepared using the following acids as dopants: (a) hydrochloric acid, (b) para-toluene sulfonic acid, (c) camphor sulfonic acid and (d) perchloric acid. A representative reaction involved dissolving aniline (0.16 ml, $1.75\times10^{-3}$ mol) in ammonium peroxydisulfate (0.1002 g, $4.39\times10^{4}$ mol) and adding 8 ml of 1 M HCl (Solution A). A dimer initiator, N-phenyl-1,4-phenylenediamine (0.0032 g, $1.74\times10^{-5}$ mol), was dissolved in 1 ml MeOH and sonicated for 5 min (Solution C). Solutions A and C were then mixed and allowed to equilibrate for 5 min before combining with an additional 8 ml of 1 M HCl to form Solution B. The container was then shaken for 5 sec. Polymerization was allowed to proceed undisturbed overnight. Purification was accomplished by dialyzing the final products against DI water; resulting in partially dedoped material.

Example 4

Polyaniline Nanofiber Film Growth 1 ml of an aqueous colloidal dispersion (4 g/L) of a partially doped polyaniline nanofibers from Example 3 was mixed with 4 ml of DI water using a high density polyethylene container (60 ml Nalgene™ Wide-Mouth). The aqueous dispersion was mixed for 30 sec, 6 ml of chlorobenzene (or chloroform) was then added and the container was shaken vigorously. The substrate, for example a clean microscope glass slide (Corning 2947), was placed into the container and shaken for 10 sec. Polymer film growth started once the container was left motionless. The container walls were tapped periodically to break up bubbles and aid film growth. Various test films were grown on a substrate. A double sided translucent film of polyaniline nanofibers was selected for analysis. In order to preserve a film's macroscopic homogeneity and nanoscale morphology it was necessary to dry it slowly under ambient conditions. Film adhesion to the substrate increased during the process of drying; a further heating at 55° C. for 48 hr provides a stable film that is, for example, robust enough to undergo characterization by cyclic voltammetry (FIG. 11). On the other hand, a newly formed wet film can be displaced from the substrate by water. Films can be made from either doped or partially dedoped nanofibers. If heavily doped nanofibers are used in the polymer solution, shaking leads to stable bubbles, but no coalescence or film growth. Due to its hydrophilicity a doped polymer climbs up the glass walls faster than a dedoped polymer.

Example 5

Polyaniline Nanofiber Films—Analysis. Cyclic Voltammetry

Cyclic Voltammetry (CV) was carried out on polyaniline nanofiber films grown on ITO-glass substrates. A monolayer of nanofibers was deposited using the method described in Example 4. The protocol for preparing films on ITO for electrochemical measurements involved drying films for 12 hr at 25° C. followed by 48 hr at 55° C. Data were collected using a Princeton Applied Research Potentiostat 263A cycling from −0.2 V to +1.2 V and then back to −0.2 V. The scan rate used was 50 mV/s. A 1 M HCl electrolyte solution was purged with argon gas for 30 sec and allowed to equilibrate for 20 sec prior to applying the potential. Clean Pt wire was used as the auxiliary electrode, a potassium chloride saturated calomel electrode served as the reference electrode, and a 25 mm×75 mm×1 mm ITO coated glass slide covered by a monolayer of polyaniline nanofibers comprised the working electrode. Conductive copper tape (3M®) was placed at the end of the working electrode to make contact with the potentiostat lead.

Scanning Electron Microscopy.

The nanoscale morphology of the various films collected on substrates was imaged with an SEM (FEI Nova 600); the samples were first plasma sputtered with a platinum layer to ensure reasonable conductivity. Conducting copper tape was used to close the electrical circuit between sample and instrument.

UV-Vis Spectroscopy.

Polyaniline nanofiber monolayers were grown on glass and quartz slides for UV-vis characterization. A substrate was introduced into a UV-vis spectrophotometer (Hewlett-Packard® HP8453 Diode-Array) in a holder designed to ensure constant position of each slide in the instrument.

The methods described above affords a simple and inexpensive solution for the growth of transparent thin films of conducting polymer nanofibers. While it is known that a fluid of lower surface tension (oil) will always spread over a fluid of higher surface tension (water) (Sawistowski, H. "Surface Tension-Induced Interfacial Convection And Its Effect On Rates Of Mass Transfer". *Chem.-Ing.-Tek.* 45, 1093-1098 (1973)), applicants have now demonstrated that an oil film can effectively carry solvated organic nanostructures across an aqueous layer present on the surface of glass. The films deposit at ambient conditions within seconds, dry in minutes, and the solvents can be recycled. Using the procedure described above, large substrate areas can be homogeneously and reproducibly coated with high quality thin films.

The utility of this process is not be limited to electrically conductive organic polymers but can also be use for forming films of other nanomaterials or combinations of nanomaterials.

GRAPHITE OXIDE AND GRAPHENE FILMS

Figures 67, 68, 69:
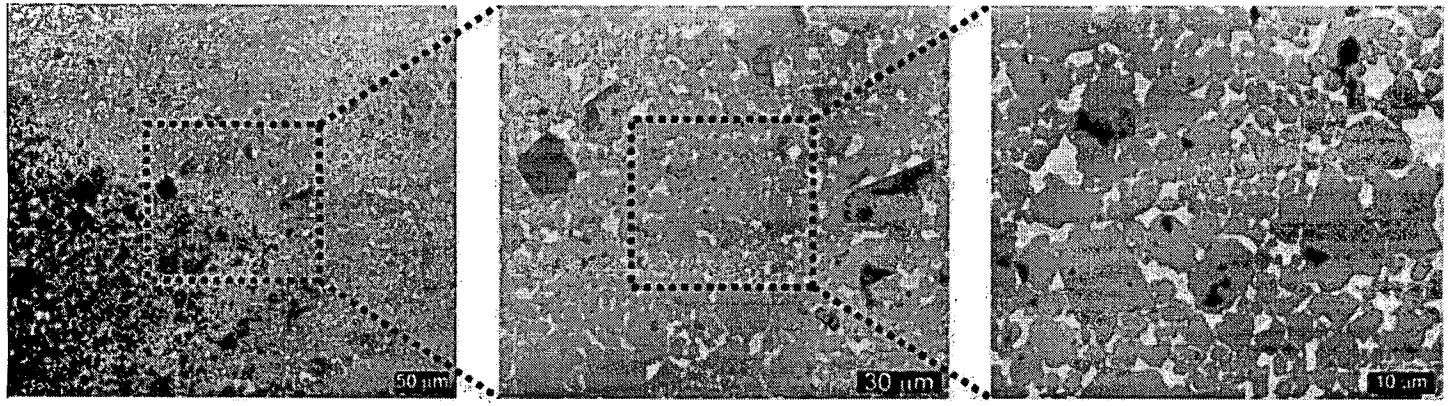
FIGS. 67, 68 and 69 are SEM images of films of graphite oxide sheets collected on a glass slide (scale bar, FIG. 67—50 μm.

Two-dimensional (2D) sheets of carbon nanostructures serve as stabilizers in Pickering emulsions with surfactant-like adsorptive properties and chemistries at liquid/liquid interfaces. The 2D liquid/liquid interface is geometrically similar to flat sheets and therefore it is an ideal accommodating environment. The abruptly different length scale in 2D carbon sheets leads to high aspect ratios affording thermodynamically favored adsorption at the interface. Graphite oxide is a single-atomic-thick amphiphile that acts as both a molecular and a colloidal surfactant at the interface between water and oil, reducing the interfacial surface tension. When an emulsion of droplets coalesces, the ensuing directional fluid flow drives graphite oxide sheets to spread interfacially over large areas. Graphite oxide sheets produced by a modified Hummer's method (Tung, V. C.; Allen, M. J.; Yang, Y.; Kaner, R. B. *Nat. Nanotechnol.* 2009, 4, 25-29). are dispersed in Milli-Q water, combined with chlorobenzene, and processed into a homogeneous thin film (FIGS. 67-69). Typically, a 0.2 mg/mL aqueous dispersion of graphite oxide sheets is emulsified with chlorobenzene in a 1:4 ratio by sonicating for 30 sec. A transparent pale yellow colored film coats a glass slide in seconds after manually agitating and setting the container to rest. Deposition of a graphite oxide film is carried out at a pH close to neutral because film growth is pH-dependent. Spreading does not occur at a high pH because the deprotonation of edge —COOH groups renders graphite oxide more hydrophilic and emulsion coalescence ejects graphite oxide back to the water phase.

Graphene is a one-atom thick planar sheet of $sp^2$-bonded carbon atoms that are densely packed in a honeycomb crystal lattice. Graphene sheets were dispersed in hydrazine aided by sonication. The sheet size can be reduced by sonicated for at least 20 minutes, preferably for about 2 hrs. The greater the sonication time the greater the reduction in sheet dimensions. In order to form a thin transparent film of highly reduced graphite oxide and graphene, a hydrazine dispersion was mixed with an aqueous solution of ammonium hydroxide. While partial oxidation occurs, some graphene sheets remained in the solution. A thin transparent film on a substrate containing single graphene sheets was then obtained using the process described above when a dilute hydrazine dispersion containing graphene is used. The quantity of material deposited on the substrate was controlled by varying the concentration of carbon material present in the aqueous dispersion used for growing a film. Microscope glass slides were used as a substrate and thin transparent films, made from dispersions of different concentrations, were produced (FIGS. 16-23). Films of highly reduced graphite oxide and graphene with a sheet resistance of 23 kΩ were grown using an 0.25 mg/ml aqueous dispersion.

Example 6

A 60 ml high density polyethylene container was used. As a general process, a hydrazine dispersion containing graphene (1-10 mg/ml) was sonicated from a few minutes to a few hours. Typically 0.4 ml of a graphene (1 mg/ml) dispersion was sonicated in 4-5 ml of a 14 wt % aqueous solution of ammonium hydroxide. 8-12 ml of an organic solvent such as chlorobenzene was then added to the sonicated graphene and the solution was further sonicated. Films were then produced by the same shake and stand process described above for producing polyaniline nanofiber films.

Figure 16:
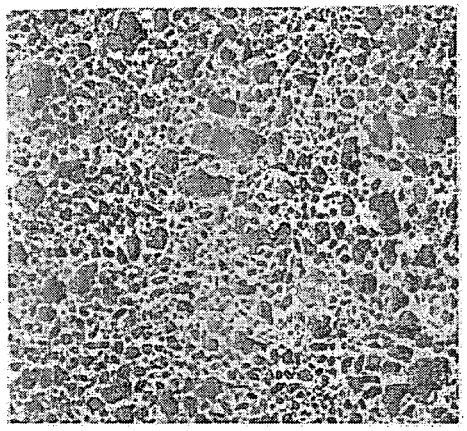
FIGS. 16 and 17 are SEM images of sheets of highly reduced graphite oxide and graphene films collected on silicon substrates comprising a 0.5 ml graphene dispersion (2 mg/ml) in hydrazine and a 0.1 ml graphene dispersion, respectively.
Figure 17:
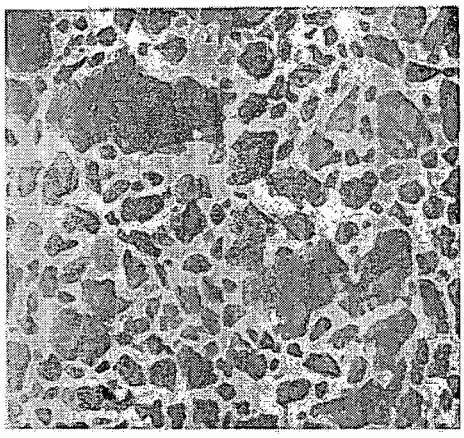

Films were deposited on silicon substrates using a 20 ml scintillation vial and a mixture comprising 0.1-0.5 ml (preferably 0.4 ml) of a graphene dispersion containing 1-5 mg/ml (preferably 1.0 mg/ml) of graphene/ml in a solution of hydrazine (2-3 ml), an aqueous 14 wt % ammonium hydroxide solution and 2-4 ml (preferably 4 ml) of an organic solvent (chlorobenzene, chloroform, carbon tetrachloride, toluene or benzene). Sonication aids in dispersing the nanostructures and in producing homogeneous films, as well as in breaking sheets into smaller sizes. Prior to depositing the film on the substrate, the substrate was treated with an oxygen plasma for 5 minutes. FIG. 16 shows a film formed from 0.5 ml of a graphene dispersion (2 mg/ml) in hydrazine; FIG. 17 shows a film formed from 0.1 ml of a graphene dispersion.

Figure 18:
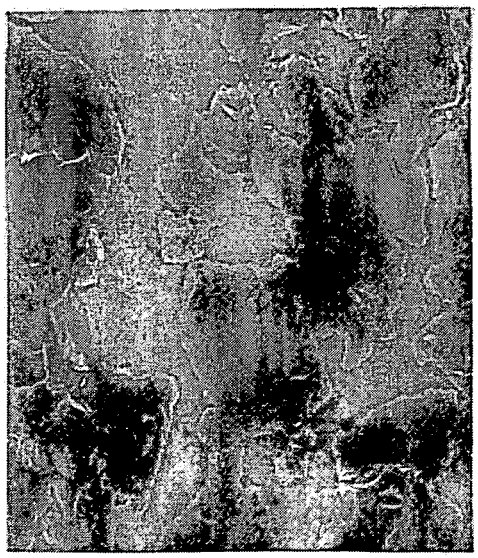
FIGS. 18 and 19 are SEM images of sheets of highly reduced graphite oxide and graphene films collected on silicon substrates.
Figure 19:
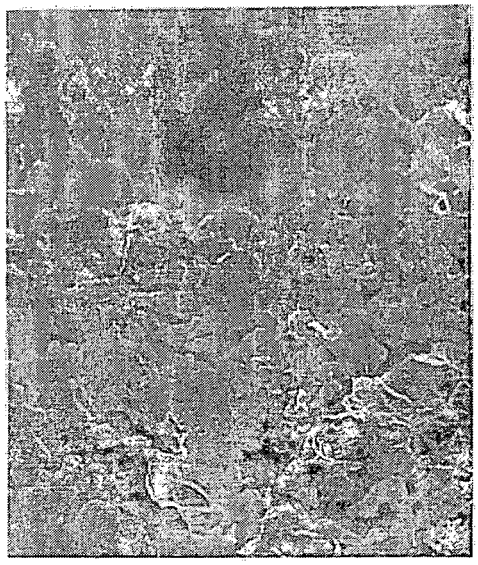
Figure 20:
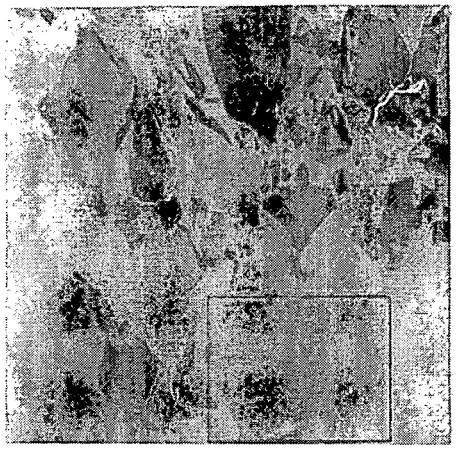
FIGS. 20, 21, 22 and 23 are SEM images of single sheets of graphene films collected on silicon substrates.
Figure 21:
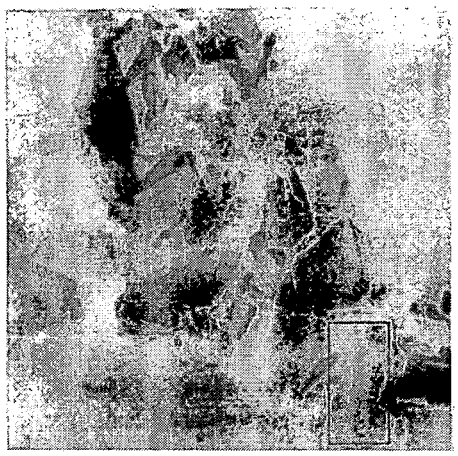
Figure 22:
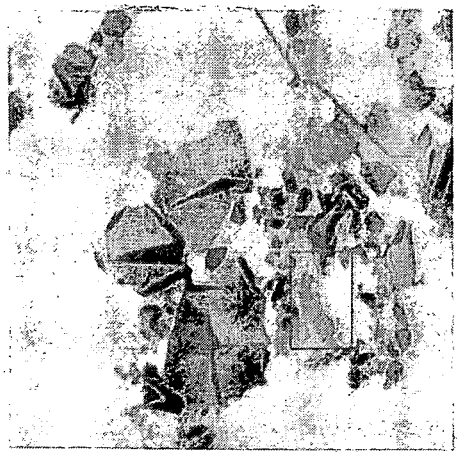
Figure 23:
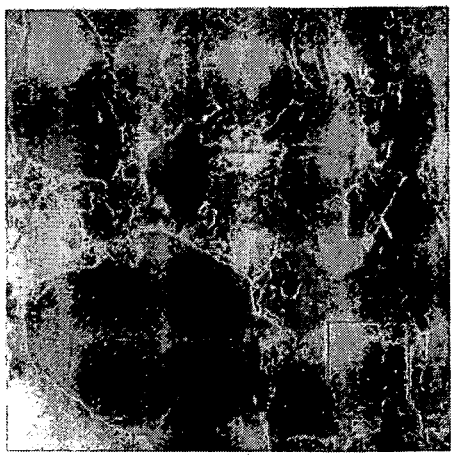

Inter-sheet connectivity leads to the formation of a conducting network. A transparent film of this material was obtained on quartz and glass slides using the process described above. Highly reduced graphite oxide and graphene sheets were dispersed in basic aqueous media via sonication. Larger sheets of graphene were produced by reducing the sonication exposure time to about 0.5 min. Films were then collected by mixing a hydrazine dispersion of graphene sheets with a 14 wt % $NH_4OH$ aqueous solution. Chlorobenzene was used as the organic phase in order to form a Pickering emulsion. When deionized water is used in place of an ammonium hydroxide solution the substrate area coverage decreases along with the maximum climbing height of a film. FIG. 18 is a top view of a film with sheets sharing edges. FIG. 19 is an image of the same film with the SEM tilted 52°.

Referring to FIGS. 20-23, films that contain single sheets of graphene were deposited by using dilute concentrations of graphene in hydrazine (1 mg/ml). Initially graphene was completely reduced in hydrazine and later combined with a 14 wt % aqueous solution of ammonium hydroxide. Films were obtained by mixing the basic $NH_4OH$ aqueous dispersion containing graphene with chlorobenzene; the vial was vigorously shaken and then allowed to stand to initiate film growth. Other solvents, such as carbon tetrachloride, chloroform, toluene, and benzene can be substituted for chlorobenzene. The rectangle in each of FIGS. 20-23 indicates a single graphene sheet.

CARBON NANOTUBES

Singled walled carbon nanotubes (SWCNT)(Carbon Solutions Inc.) were functionalized with carboxylic acids and hydroxyl groups.

Example 7

Growing a SWCNT Film on a Glass Slide (75 mm×25 mm×1 mm)

Singled walled carbon nanotubes (0.0011 g of SWCNT (Carbon solutions Inc.)) were mixed in a 20 ml glass scintillation vial with 4 ml of water and sonicated for 15 min. 11 ml of chlorobenzene was then added followed by sonication for an additional 15 min. 3 drops of concentrated HCl were added, mixed and the solution was transferred into a 60 ml propylene container (BD Falcon™ tube). A glass slide (Corning 29470 was cleaned with a Kimtech® wipe soaked with isopropyl alcohol, dried with compressed air, and placed into the container. Agitation and standing was repeatedly carried out. A film of the highest quality was obtained after about 5 minutes.

Example 8

Growing a SWCNT Film on Silicon (49 mm×10 mm×1 mm)

0.1 mg of SWCNT was mixed in a 20 ml glass scintillation vial with 2 ml of deionized water and sonicate for 15 min. 5 ml of chlorobenzene was then added followed by sonication for an additional 15 min. 3 drops of concentrated HCl was then added and the mixture was shaken. The solution produced a high quality film in about 5 minutes. It was noted that use of acid leads to agglomerates.

Example 9

SWCNT Single Sided Films on Glass Slides

Figure 24:
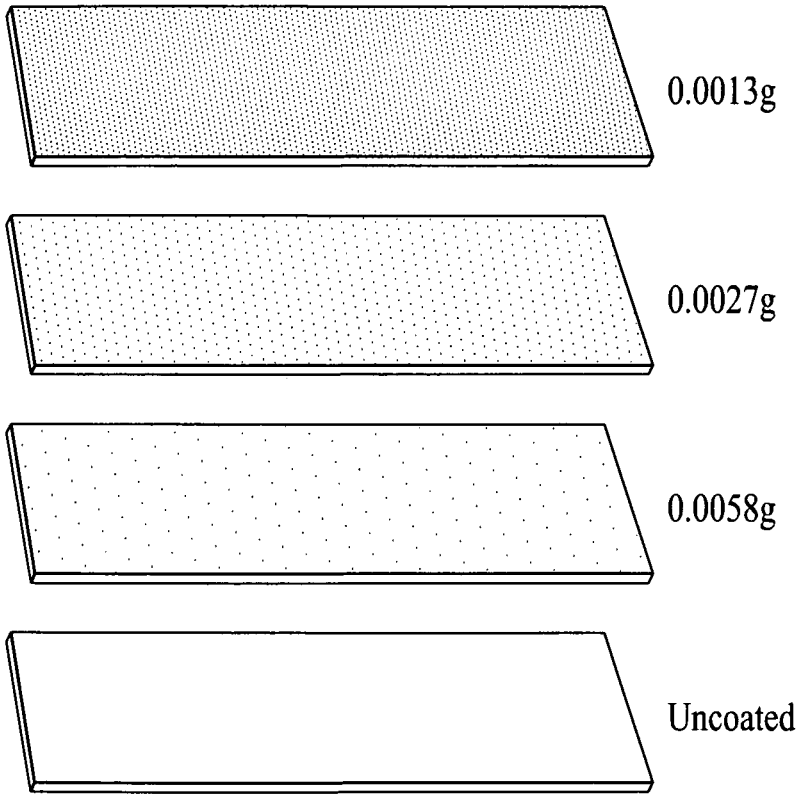
FIG. 24 shows three different films of single walled carbon nanotubes deposited on glass slides, the images stippled to represent different film densities.

Films were collected using a Falcon tube, water, and chlorobenzene. Addition of each component into the mixture was followed by 15 min sonication. FIG. 24 schematically represents films of carbon nanofibers on glass slides with different stippling to represent different film densities where:

the lower slide is an uncoated slide blank;

the next is a glass slide with a film formed using 0.0058 g of SWCNT, 6 ml of water, and 15 ml of the organic oil;

the third image is a glass slide with a film formed using 0.0027 g of SWCNT, 4 ml of water, and 11 ml of the organic oil; after agitation of the mixture 5 drops of concentrated acid were added to the mixture prior to forming the film on the substrate; and the upper image shows a film formed on a glass slide using 0.0013 g of SWCNT, 3 ml aqueous solution containing 10% ethanol, 9 ml organic oil and 4 drops of concentrated HCl; the organic oil was chlorobenzene in each instance. Also other alcohols can be substituted for ethanol.

| Film Transparency | Sample | SWCNT (g) | HCl (drops) | EtOH (ml) | Water (ml) | Oil (ml) | W:O ratio |
|---|---|---|---|---|---|---|---|
| Uncoated | bottom | | | | | | |
| light | 2nd | 0.0058 | 0 | | 6 | 15 | 0.4 |
| medium | 3rd | 0.0027 | 5 | | 4 | 11 | 0.36 |
| dark | top | 0.0013 | 4 | 0.3 | 3 | 9 | 0.33 |

The mass of solids deposited on a substrate has an inverse relationship with a film's transparency. By using SWCNT dispersions of different concentrations films are produced in a range of transparencies. Films with 95% and 90% transparencies were obtained from 0.01 mg/mL and 0.1 mg/mL aqueous dispersions. Addition of 2% ethanol leads to a film with a 70% transmittance. Ethanol lowers the surface charge of SWCNTs and reduces their interfacial energy allowing them to assemble at liquid/liquid interfaces. A film with a 90% transmittance possesses a 1 kΩ sheet resistance.

Controlling the packing density in a film of aligned SWCNTs can be carried out via post-production annealing at 300° C. for 12 h leading to well separated carbon ropes and stronger film adhesion to a substrate. Alternatively, the mixing protocol of an aqueous dispersion also controls the packing density. Extended sonication in a standard ultrasonic bath for 2 h, using a 0.1 mg/mL aqueous dispersion, provides well separated carbon ropes, and a coating of aligned SWCNTs possessing a low packing density.

Figure 60:
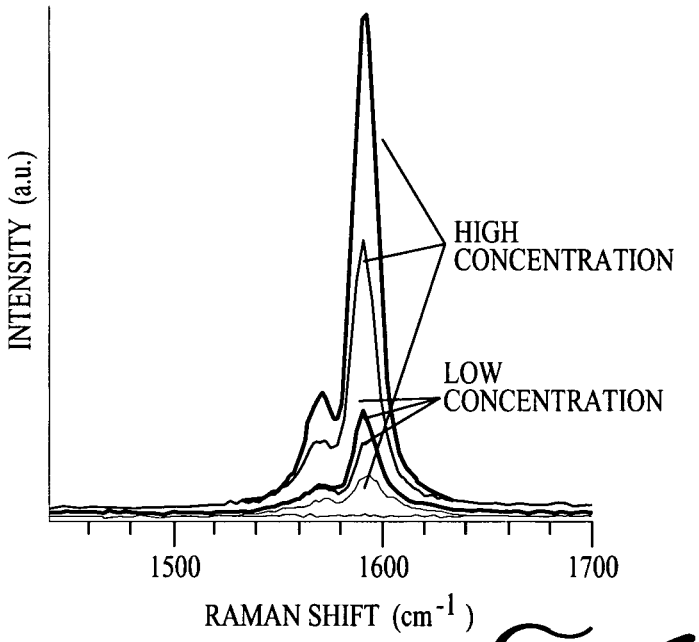
FIG. 60 is a graph showing the Raman spectra of films formed using the process shown in FIGS. 54-59.

Raman spectroscopy shows a low to high signal intensity gradient along the height axis of a film (FIG. 60). Spreading of an interfacial concentration gradient leads to the anisotropic distribution of mass and explains why the intensity gradient shows a stronger signal for higher areas of the substrate.

FIGS. 25-28 are photomicrographs of SWCNT films.

Figure 25:
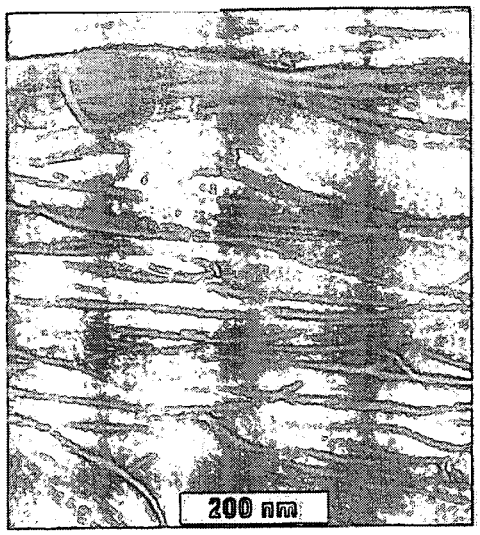
FIGS. 25, 26, 27 and 28 are SEM images of films of single walled carbon nanotubes (SWCNT) collected on silicon substrates from an aqueous media.

FIG. 25 shows a film on a silicon substrate collected using 0.0005 g of SWCNT in 2 ml water and 6 ml of chlorobenzene. FIG. 25 is a SEM image of a single-walled carbon nanotube film grown on a silicon substrate as described above. This film shows alignment of ropes of carbon nanotube. The substrate is visible between the ropes, providing a porous morphology typical of these films. The diameter of the ropes can be controlled by the extent of sonication. The SEM image shows a film formed from a SWCNT dispersion sonicated for 30 minutes; the sample being tilted 52 degrees.

Figure 26:
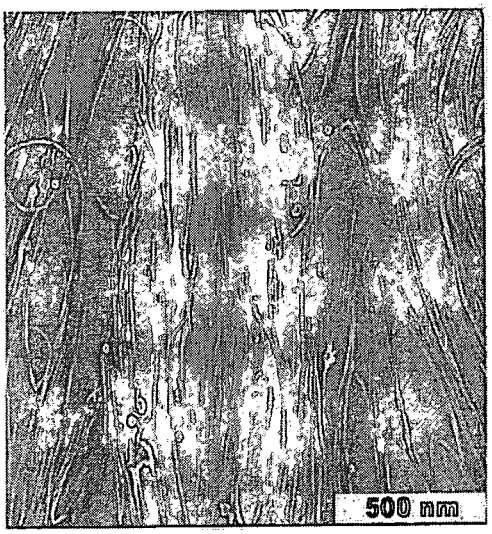

FIG. 26 is an SEM image at 2.5 times the magnification of another film formed in the same manner as FIG. 25 with sonication for 15 minutes. At the higher magnification the ropes of carbon nanotubes are shown to be not as well dispersed as in FIG. 25 because of less sonication. This SEM image was collected with the sample positioned perpendicular to the microscope.

Figure 27:
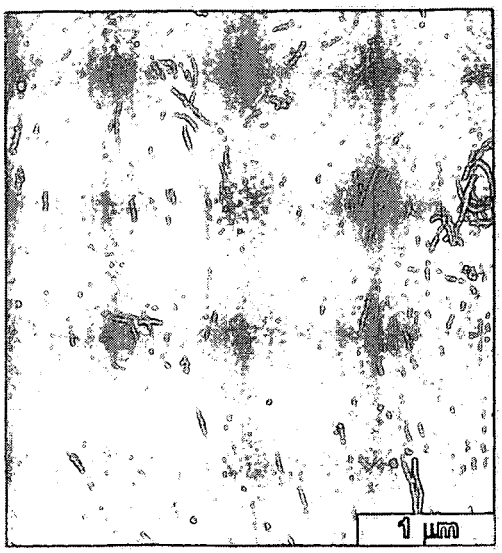

FIG. 27 is an SEM image (the scale bar is 1 micrometer) of a single-walled carbon nanotube film grown on a silicon substrate. Entanglements (aggregated carbon nanotube ropes), present because acid was used for film deposition, have a lighter colored appearance. The concentration of acid used has a direct impact on aggregate formation because acid protonates the carbon nanotubes and leads to a higher degree of hydrogen bonding. This SEM image was collected with the sample positioned perpendicular to the microscope.

Figure 28:
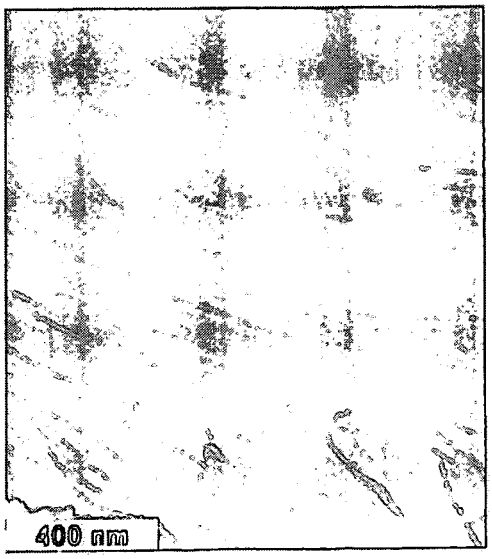

FIG. 28 is an SEM image of a single-walled carbon nanotube film grown on a silicon substrate. Highly aligned carbon nanotube ropes are present due to a well dispersed morphology achieved by sonicating the SWCNT aqueous dispersion for 45 min. The SEM image was obtained with the sample tilted at 52 degrees.

Figure 29:
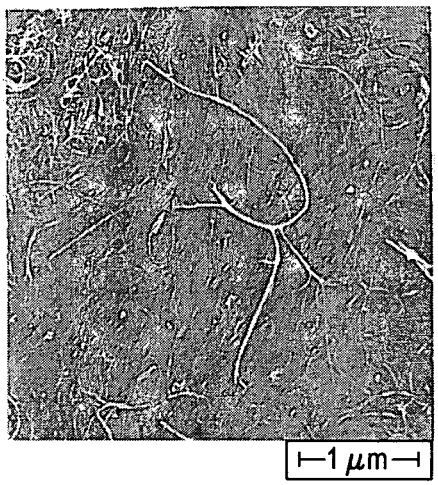
FIGS. 29, 30 and 31 are further SEM images of single walled carbon nanotube (SWCNT) films collected on silicon substrates from aqueous media.
Figure 30:
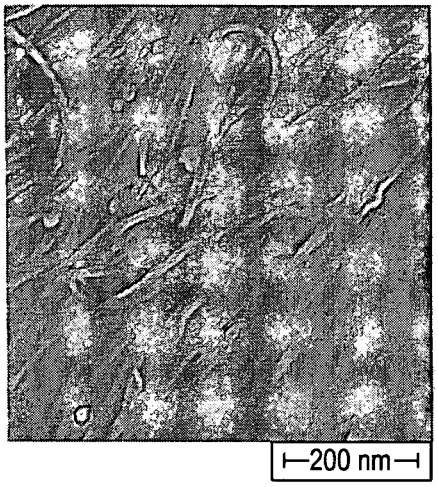
Figure 31:
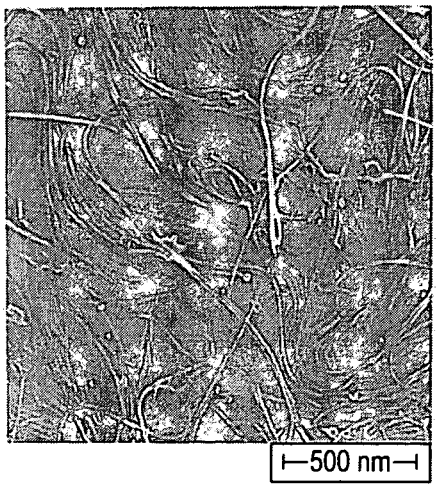

The films shown in FIGS. 29-31 were prepared from aqueous dispersions of 0.1-1.0 mg of SWCNT in 2 ml of deionized water mixed and sonicated for 10 min in a 20 ml glass scintillation vial. Chlorobenzene (3-6 ml), (preferably 5 ml) was then added and the solution was sonicated for another 10 min. The vial was repeatedly shaken throughout the sonication process. The solution was then allowed to rest undisturbed. Films were formed from the resting solutions on a silicon substrate pre-treated in an oxygen plasma for 5 min. The films were then dried in the vial for 10 minutes where they were exposed to chlorobenzene vapor, removed from the vial and then further dried for 2 hours at ambient conditions. FIGS. 29-31 are photomicrographs at various magnifications of films formed from SWCNT concentration of 1 mg/ml.

Individual SWCNTs deposit as a film when cast from a dilute and highly purified aqueous dispersion. A 5 mg/mL aqueous dispersion of SWCNT containing 30% by volume hexafluoroisopropanol was sonicated in an ice bath for 1 hr using a horn tip at 100% power output. Centrifugation at 112×g for 30 min, separation of the top portion of the supernatant, dilution to 50% using deionized water, and extended sonication produces a purified stable dispersion. This purification process was repeated 4 times in order to obtain a highly dilute and transparent SWCNT aqueous dispersion. A 1 mL aliquot and 4 mL of chloroform were mixed via extended sonication using an immersed horn tip; the coalescence of a Pickering emulsion leads to spreading.

Figure 61:
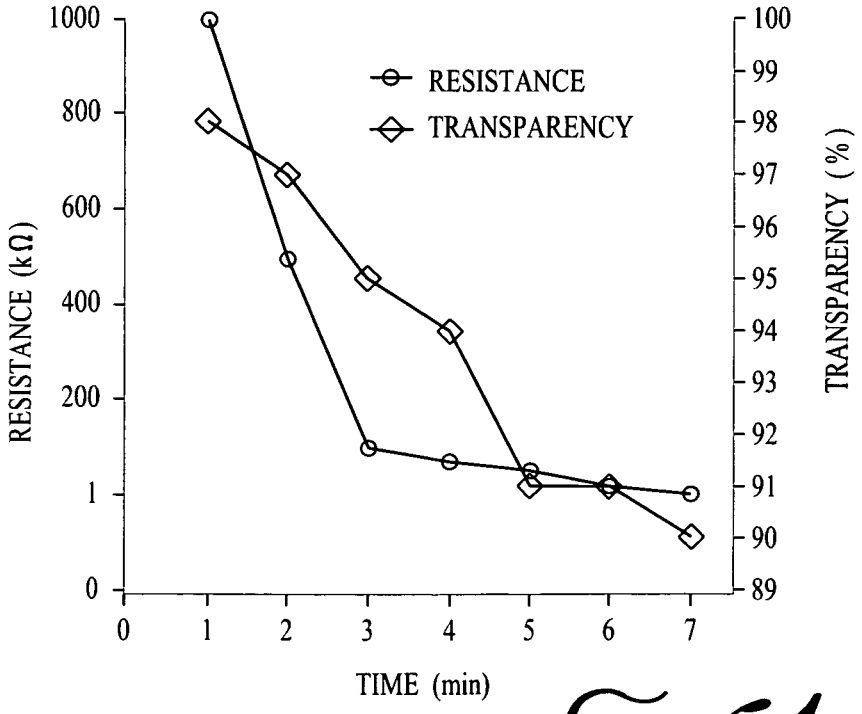
FIG. 61 is a graph showing the resistance and transmission of films as a function of the agitation time of the emulsion.
Figures 61, 62, 63:
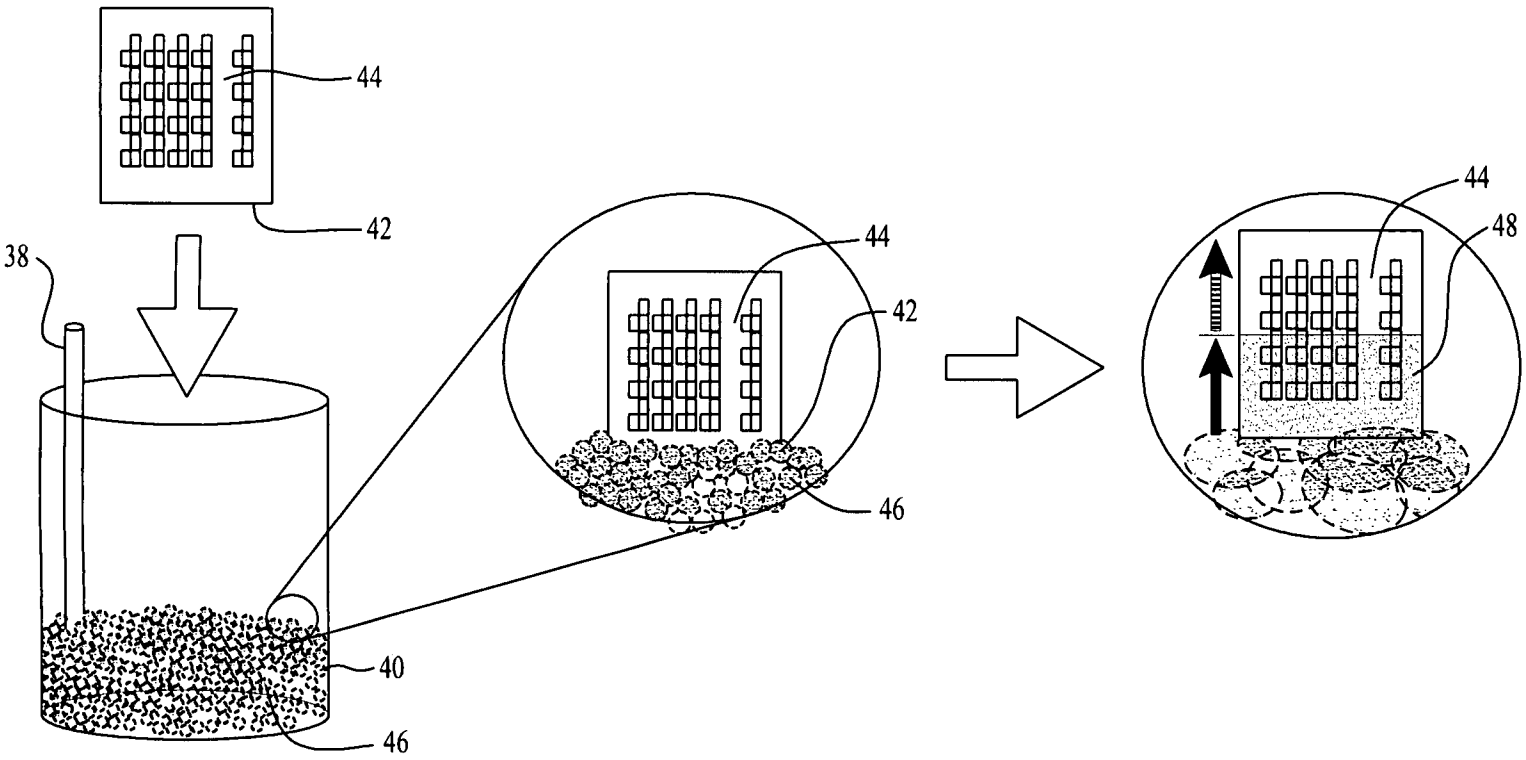

Referring to FIGS. 62-64, film deposition can be automated by using a sonicating tip 38 to emulsify components in a container 40. Only the edge 42 of a wet substrate 44 to be coated is placed into the emulsified composition 46. Coalescence and film 48 growth over the wet substrate 44 proceeds once the sonic energy is turned off. This procedure produces thin films of well separated SWCNT ropes and individual carbon nanotubes.

COMPOSITE FILMS

Figure 32:
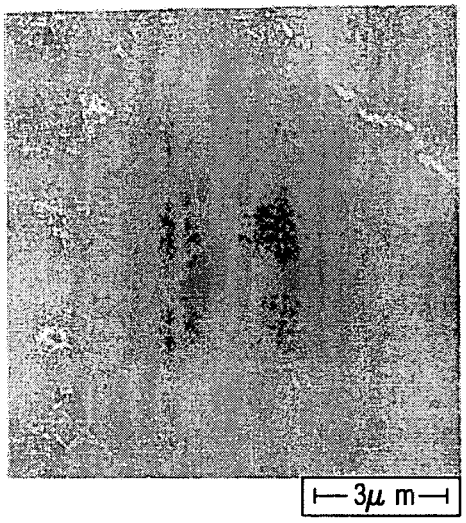
FIGS. 32 and 33 are further SEM images of single walled carbon nanotube (SWCNT) films collected on silicon substrates from basic aqueous media.
Figure 33:
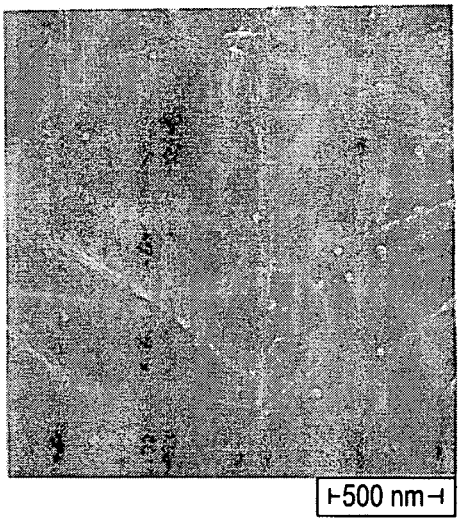

Shown in FIGS. 32 and 33 are films produced using the same technique described above for growing graphene films. FIG. 32 shows amorphous carbon present in the film, probably due to hydrazine and sonication treatments. Annealing of the film surface using a scanning electron microscope (the darkened central portions of FIG. 32) was achieved by increasing the accelerating voltage (18.00 KV), which burns off the amorphous carbon while carbon nanotubes remain. FIG. 33 is an enlarged image showing the annealed area of FIG. 32 with a carbon nanotube network underneath an amorphous carbon layer.

Figure 34:
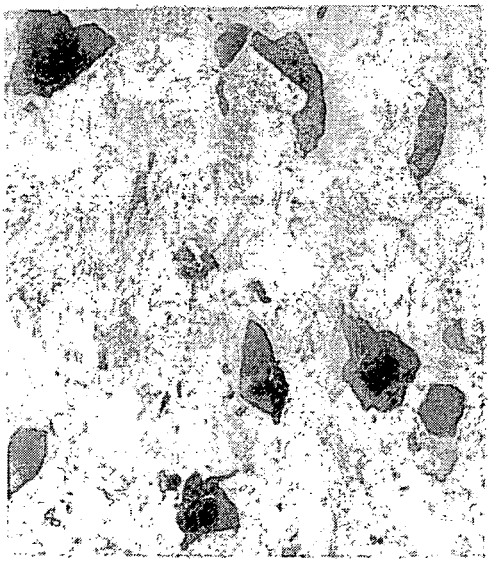
FIGS. 34, 35, 36 and 37 are SEM images of films of SWCNT-graphene composites produced after exposure to prolonged sonication prior to film growth, the films being formed on silicon substrates.
Figure 35:
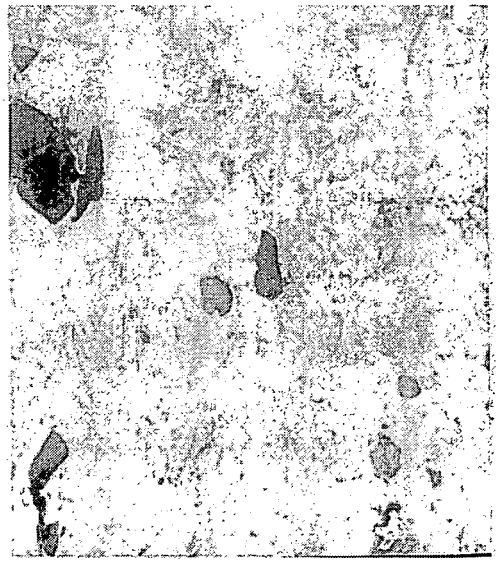
Figure 36:
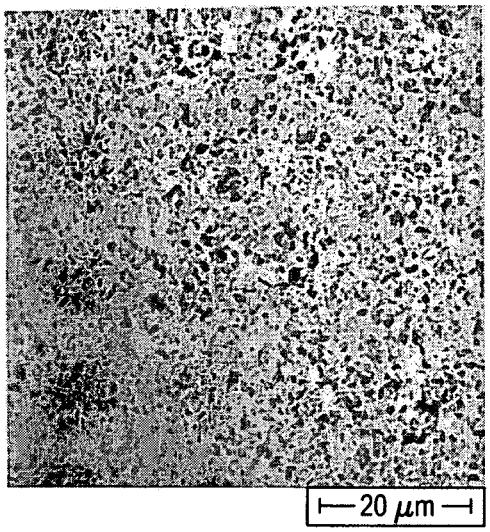
Figure 37:
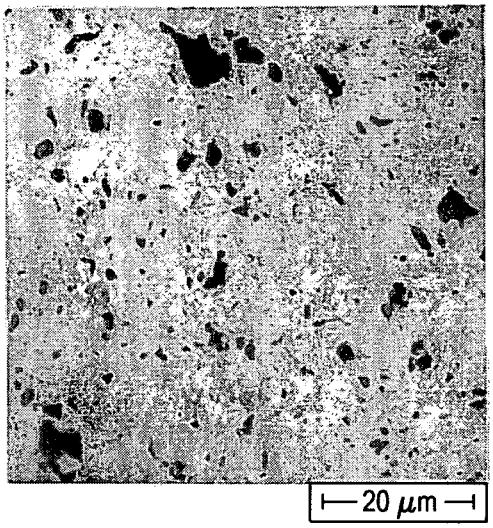
Figure 38:
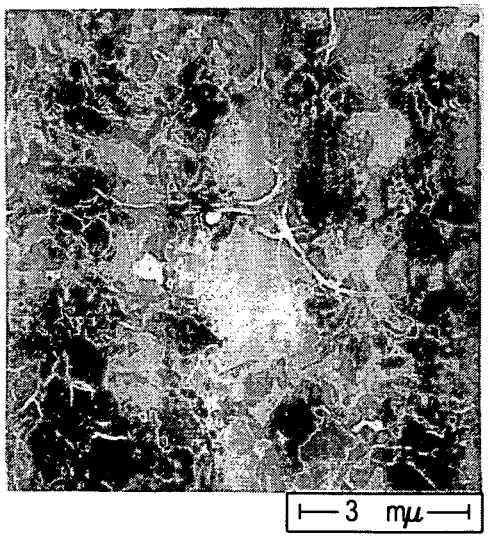
FIGS. 38, 39, 40 and 41 are further SEM images of films of SWCNT-graphene composites sonicated for varying time intervals prior to film growth and collected on silicon substrates.

FIGS. 34, 35, 36 and 37 are SEM images of films of SWCNT-graphene composites produced after exposure to prolonged sonication prior to film growth, the films being formed on a silicon substrate. Both materials are mixed, dispersed in hydrazine, and sonicated prior to film growth. The images illustrate the reduction in the size of the graphene sheets after extended sonication treatment (for at least about 20 minutes). Films of the composite are obtained via the same technique used for growing graphene films discussed above. FIGS. 34 and 35 show a film formed from a low concentration of SWCNT (0.1 mg/ml). FIG. 36 illustrates a film formed from an increased concentration (1.0 mg/ml) of a highly reduced graphite oxide and graphene hydrazine dispersion, leading to a denser nanostructured network. FIG. 37 shows a film formed where the concentration of SWCNT in the hydrazine dispersion (2.0 mg/ml) is increased to form a dense network of highly reduced graphite oxide and graphene sheets interconnected via carbon nanotubes.

FIGS. 38, 39, 40 and 41 are SEM images of films of SWCNT-graphene composites sonicated for approximately 15 minutes prior to film growth and collection on silicon substrates.

The films in FIGS. 38-41 were produced by mixing 0.15 ml of a 5 mg/ml hydrazine dispersion of graphene and SWCNT with 2 ml of a 14 wt % $NH_4OH$ solution. The solution was sonicated for 60 sec. Chlorobenzene (3-4 ml) was then added and a film was formed on a substrate after shaking the solution and allowing the vial to stand.

Figure 39:
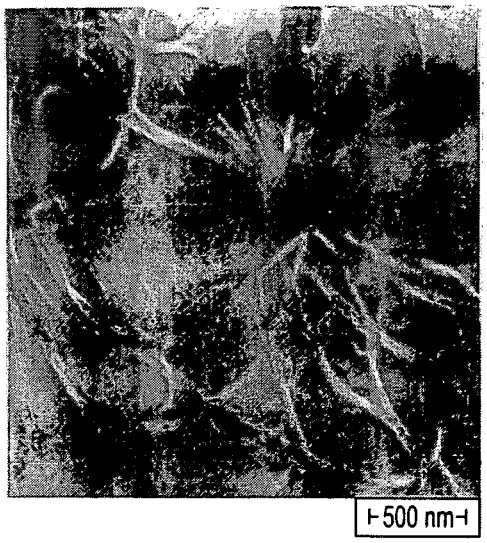
Figure 40:
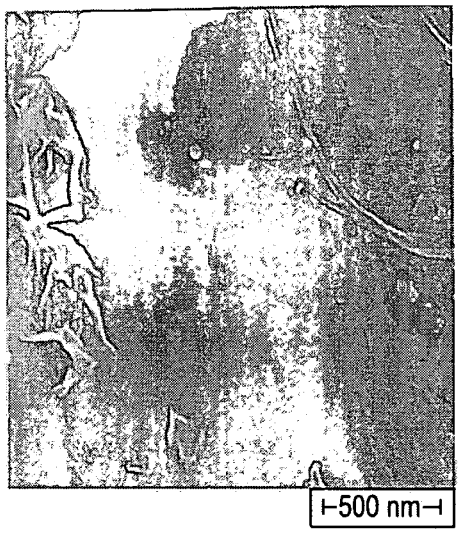
Figure 41:
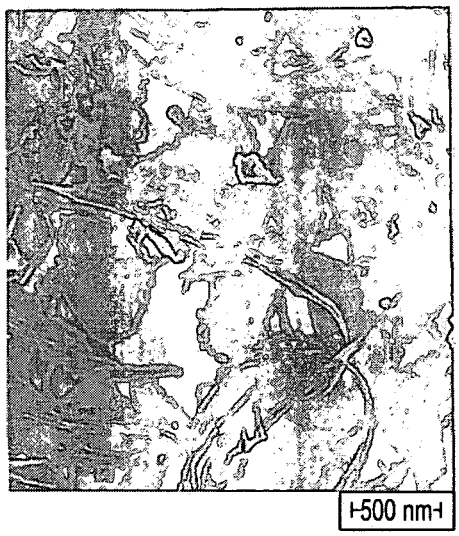

FIGS. 38-41 are four different examples of films prepared using the same procedure, FIGS. 39-41 being at a higher magnification.

Figure 42:
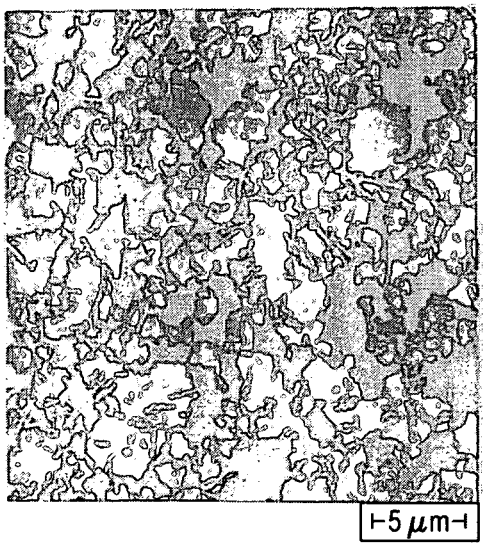
FIGS. 42, 43, 44 and 45 are SEM images of films of polyaniline nanofiber-graphene composites collected on silicon substrates using the process described herein.
Figure 43:
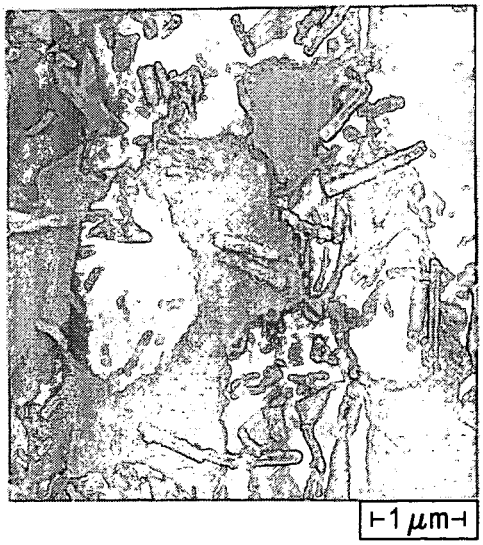
Figure 44:
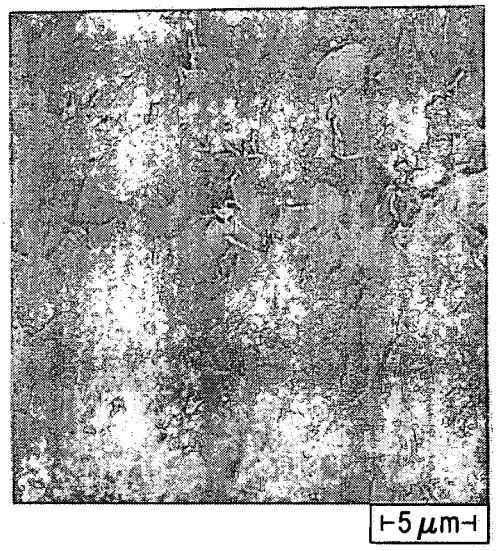
Figure 45:
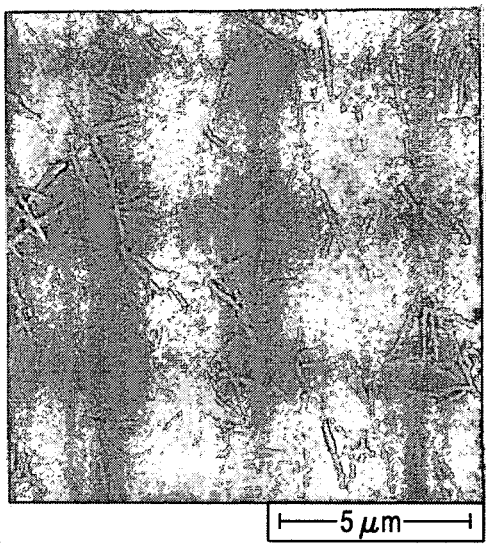
Figure 46:
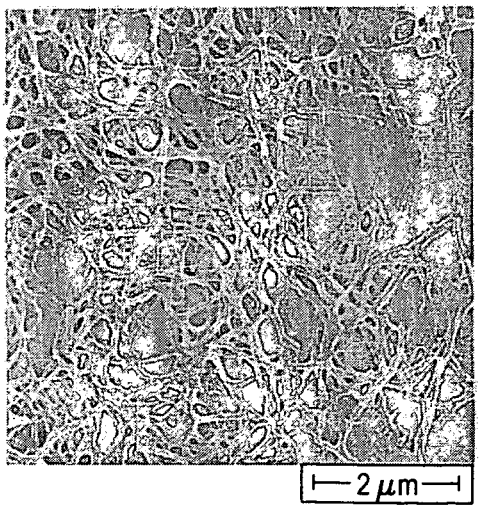
FIGS. 46, 47, 48, 49 and 50 are SEM images of films of polyaniline nanofiber-SWCNT composites collected on silicon substrates.
Figure 47:
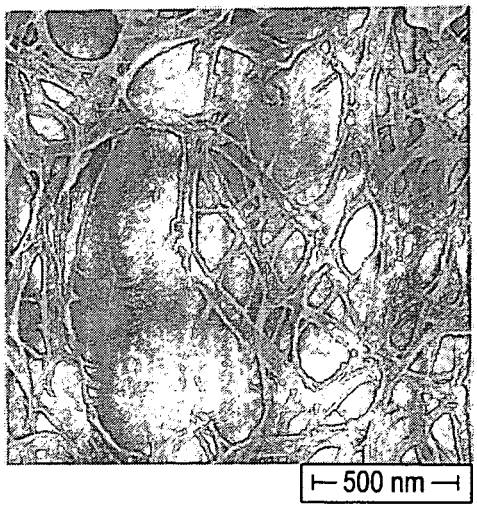
Figure 48:
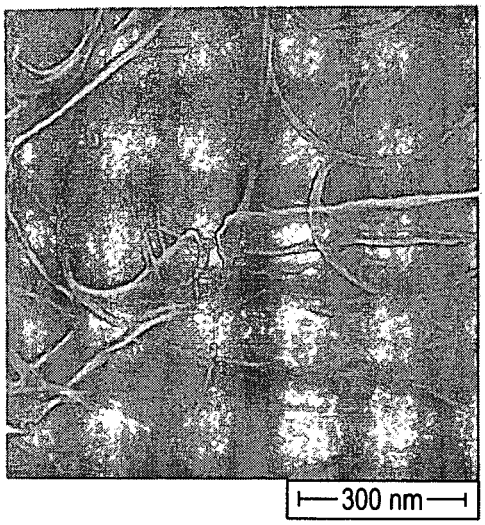
Figure 49:
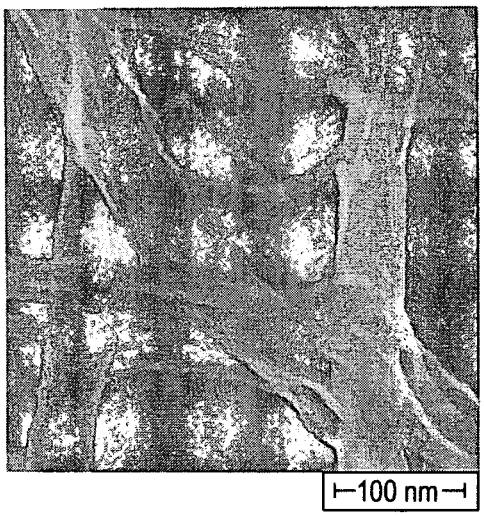
Figure 50:
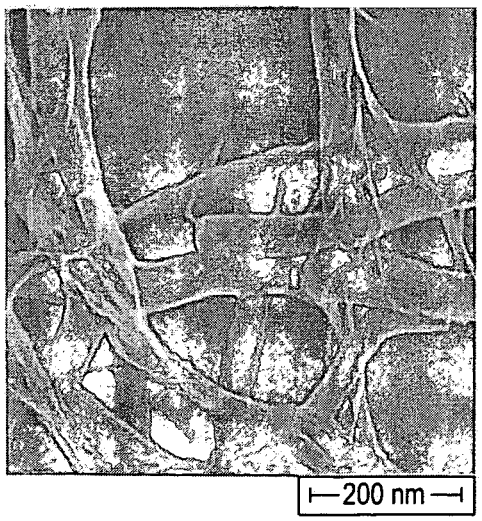

FIGS. 42, 43, 44 and 45 are SEM images of films of polyaniline nanofiber-graphene composites collected on silicon substrates using the process described herein. A graphene film was first produced as described above using the process of Example 6. The film was allowed to dry for 1 hour and a doped polyaniline nanofiber dispersion was then used to grow a film of the polyaniline nanofibers on top of the previously grown graphene film. FIGS. 42 and 43 show the film after exposure to ammonium hydroxide vapors, the polyaniline nanofibers are dedoped due to the ammonium hydroxide exposure. FIG. 43 is a higher magnification image of FIG. 42. FIGS. 44 and 45 show films of doped polyaniline nanofibers on top of highly reduced graphite oxide and graphene sheets at two different magnifications. (FIG. 44 is 2× FIG. 45).

FIGS. 46-50 are SEM images of a film of a polyaniline nanofiber-SWCNT composite collected on silicon substrates, the 5 images showing the film at different magnifications (reference is made to the dimension bar in the lower right corner of each image). The films were grown using the same method described above except that 0.4 ml of an aqueous dispersion (4 g/L) of perchloric acid doped polyaniline nanofibers was added to an aqueous dispersion of SWCNT. No base is used and the SWCNT are not pre-dispersed in hydrazine but are directly mixed with water from the solid state. Film growth is carried out using chlorobenzene and a Si substrate. Carbon ropes made up of bundles of SWCNT intertwine with the polyaniline nanofibers are shown.

Figures 51, 52, 53:
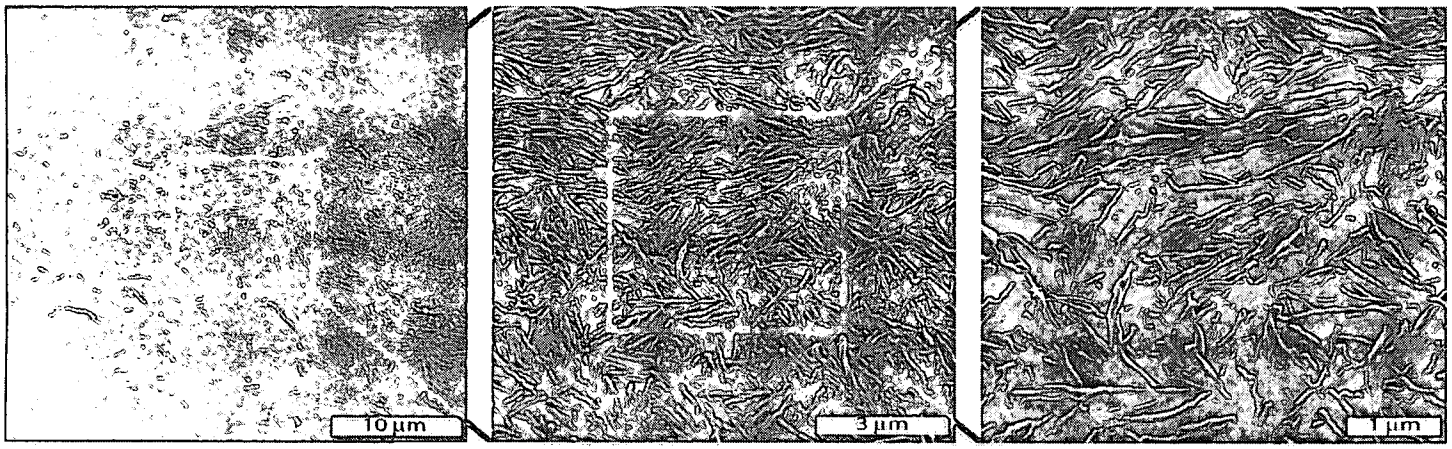
FIGS. 51, 52 and 53 are SEM images of films of poly (3-hexylthiophene) nanofibers collected on a silicon substrate (scale bar, FIG. 51—10 μm.

In a similar manner, transparent films of Poly(3-hexylthiophene) nanofibers were grown on a substrate using the same method for producing polythiophene films except that the organic solvent was an alkane such as hexane or heptane. FIGS. 51-53 are SEM images at three different magnifications of poly(3-hexylthiophene) nanofibers film formed on a silicon dioxide substrate using methods described herein. FIG. 53 is a magnified image of the central portion of FIG. 52; FIG. 52 is a magnified image of the center portion of FIG. 51.

Non-activated hydrophobic surfaces can also be coated with a transparent and conductively continuous film using, for example, the procedure of FIG. 54-59 or 62-64, and a binary mixture of immiscible solvents of opposing polarity. When this binary solvent system makes contact with a solid it leads to the spontaneous displacement of a fluid from the surface of the solid by another liquid in what is known as selective wetting. Thin film deposition on a low surface energy solid requires a solvent of extremely low surface tension. As an example, mixing water and a fluorocarbon provides selective wetting and film growth on a non-activated hydrophobic surface. A fluorocarbon, a liquid of low surface tension, wets plastics, impregnates polypropylene film capacitors, and imparts water repellency to polyester fabrics. An extremely low cohesion exists between fluorocarbon molecules leading to the complete wetting of plastics. The low surface tension of a fluorocarbon stems from the low polarizability of the fluorine atom and leads to immiscibility with water which is a polar liquid of high surface tension (72.8 mN/m). Fluorocarbons such as perfluoro-2-butyltetrahydrofuran, perfluoro(methylcyclohexane), Fluorinert® FC-40 (16 mN/m), Fluorinert® FC-70 (18 mN/m), and Fluorinert® FC-77 (15 mN/m) (Fluorinert® is a trademark of 3M) were employed in this procedure.

Vigorous agitation of water, fluorocarbon, and carbon nanotubes leads to droplets. Upon contact with a non-activated hydrophobic substrate the fluorocarbon displaces water from the surface leading to selective wetting. Droplet coalescence is highly energetic as a result of the extreme surface tension difference between solvents. Carbon nanotubes, partially coated by both solvents, are immediately expelled out of droplets and adsorb at the water/fluorocarbon interface present on a substrate. Adsorption is enhanced by the hydrophobic interactions between SWCNTs and fluorocarbons. Interfacial spreading minimizes the total interfacial surface energy of the system and leads to adsorption and deposition of SWCNTs.

A high quality transparent film of carbon nanostructures coats a suitable substrate after immersion in a perfluorinated emulsion of droplets. The time that a substrate remains in contact with droplets determines the mass of carbon that adsorbs. Increasing the length of time leads to a higher concentration of adsorbed solids and changes the wetting properties of a substrate from hydrophobic to hydrophilic. When a dense film of carbon nanotubes coats the substrate the surface energy changes, the substrate behaves like a hydrophilic surface, and is wetted by water. Vertical film spreading, typically observed on a hydrophilic surface, can therefore be induced after adsorption of a dense coating of SWCNTs.

Deposition of a large and transparent conducting film of SWCNTs can be obtained by first coating a 22×22 $cm^2$ area of a non-activated hydrophobic flexible substrate, such as a polyester substrate. A coating emulsion is produced using a horn sonicator by mixing 400 mL of Fluorinert FC-40 and 200 mL of a 0.05 mg/mL aqueous dispersion of SWCNTs. The sonicator is set to 100% power output and mixing is carried out in an ice bath for 2 h. The substrate and carbon emulsion were then housed in a snug fitting container and manually and vigorously agitated for 10 min. Once coated, the oriented polyester substrate (Grafix® Plastics) was removed from the encasing vessel and allowed to dry at ambient conditions; the fluorocarbon evaporates cleanly from the surface and leaves no residue. A double sided film with a transparency greater than 90% and a sheet resistance of 1 kΩ was produced using this procedure.

A transparent film of SWCNTs on non-activated plastic can be deposited on an optically transparent vinyl slide by combining 2 mL of a 0.1 mg/mL aqueous dispersion of SWCNTs and 8 mL of a perfluorinated hydrocarbon such as Fluorinert FC-40. Emulsification was then carried out in a snug fitting container by manually agitating components for 1 min. A coated slide was removed from the solution, washed with water in order to remove excess adsorbates, and allowed to dry at ambient conditions. FIG. 61 is a graph showing the properties of a conductively continuous film that is 98% transparent possessing a 1 MΩ sheet resistance. The edges of the plastic substrate are homogeneously coated and possess a uniform sheet resistance, the center has a resistance two orders of magnitude higher. This lack of uniformity is remediated by simply agitating for longer than 1 min as demonstrated by the improvement in the stability of the resistance after 5 min. Contact between a substrate and coalescent droplets leads to the adsorption of SWCNTs; the longer the contact the greater the bulk uniformity of a film. Agitation for 7 min leads to a 90% transparency and 1 kΩ sheet resistance across the entire coated surface area.

As another example, a transparent film of perchloric acid doped polyaniline nanofibers was deposited on an oriented polyester substrate (10.2 cm×8.4 cm×0.0254 cm); it was coated via directional fluid flow, using 6 mL of an aqueous polymer dispersion [4 g/L], 3 mL of water, and 60 mL of a perfluorinated fluid such as Fluorinert FC-40®. All chemicals were combined and vigorously agitated in a 250 mL wide mouth glass jar, and a clean hydrophobic substrate was then introduced into the glass jar's liquid/liquid interface. This set-up was then vigorously agitated and a green film immediately deposited on the plastic substrate. The coated green colored substrate was removed after 1 min of agitation, washed with water, and allowed to dry at ambient conditions producing a continuous and conductive film.

Molecular interactions between the free surface energy of interfacially adsorbed nanofibers and the substrate can dictate film morphology. Perchloric acid doped polyaniline forms a film with an average thickness of a single nanofiber. This occurs because the nanofibers are interfacially extruded when sandwiched between a layer of oil and a layer of water such as shown in FIG. 8, which shows a close-up image of nanofibers assembled in the form of a continuous film. Single monolayers of polyaniline nanofibers can also be deposited using dopants such as camphorsulfonic acid or para-toluene sulfonic acid. Films possess conductivities of up to 3 S $cm^{-1}$ and can be patterned using a PDMS stamp.

A substrate-free film can be produced by transferring a partially wet film from the air/water interface present on a hydrophilic surface, to the air/water interface present in a liquid reservoir. By controlling the degree of wetness in a film, delamination at the air/water interface is achieved. A film of SWCNTs on a glass slide was allowed to dry slowly by keeping the container lid closed for 5 min after deposition. The film was dried for 1 min under ambient conditions before it was delaminated using a 1 M HCl aqueous solution. Protonation of —COOH functional groups leads to hydrogen bonding between carbon nanotubes and tight packing in 2D; a delaminated floating film does not need compression. A film remains as an entire piece due to the cohesive molecular interactions of the carbon amphiphiles comprising the film structure. Prior methods for fabricating and delaminating a single SWCNT film required a polymeric dispersant such as poly(3-hexylthiophene), hydrazine treatment, and a 3 hr process. Using the procedure described herein freestanding SWCNT films were produced in minutes without a polymeric dispersant. The entire film delaminates at the air/water interface as a single piece, and a homogeneous freestanding film remains floating for days.

When a freestanding film of SWCNTs is transferred from glass to $SiO_2$ the morphology of the film retains alignment in the micrometer scale. A freestanding film is electrically continuous and can be transferred to any type of substrate by scooping it up from the surface of water. During delamination on acidic media the film shrinks due to protonation of —COOH functional groups and the packing density increases due to stronger cohesive interactions. Layer-by-layer deposition is carried out by scooping up multiple layers and annealing each at 100° C. for 4 h before depositing another film on top of the prior deposited films.

Figure 65:
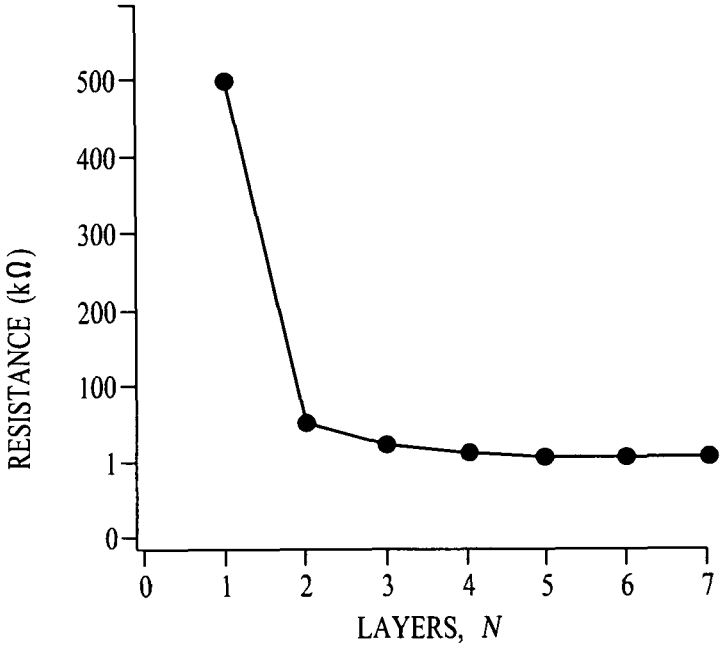
FIGS. 65 and 66 are graphs showing film resistance and transmittance, respectively, as a function of the number of film layers.
Figure 66:
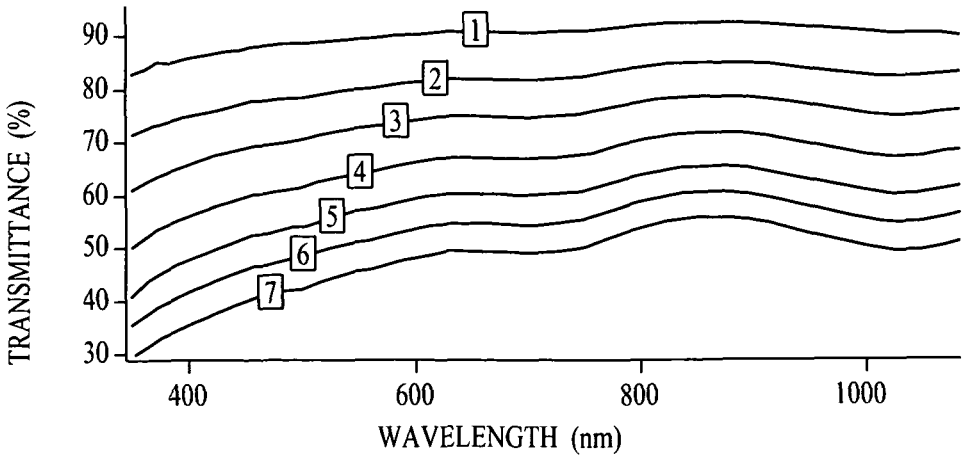

The optoelectronic properties of a multi-layered SWCNT film prepared by delaminating and transferring freestanding layers are shown in FIGS. 65 and 66. A single transferred layer has a sheet resistance of 500 kΩ (FIG. 65) and transparency greater than 82%. Deposition of a second layer reduces the sheet resistance by an order of magnitude and establishes a percolation threshold. Addition of three or more layers have less effect on the sheet resistance. The electrical stability of a film increases after stacking two or more layers as demonstrated by the less positive slope value of the curve. Each layer decreases the transparency by an average of 10 absorbance units (FIG. 66). This large optical density stems from compression of SWCNTs during delamination on a 1 M acid causing the film to shrink and the packing density to increase. Replacing the delaminating media with a 5% ethanol solution leads to higher transparencies.

One skilled in the art, based on the description and examples set forth, above will recognize that the invention is not limited by said representative examples and that variations thereof are within the scope of the invention. For example, various nanofibers and nanostructures comprising various different materials are disclosed. However, the method disclosed herein also contemplates the application to other nano-structures and other materials, for example deoxyribonucleic acid and various nanoforms of thiophenes, including other thiophenes such as poly(3,4-ethylenendioxythiophene) as well as polystyrene nanobeads, and other nanoforms of carbon such as carbon nanoscrolls or carbon black nanoparticles. Still further, numerous immiscible organic liquids can be used such as nitromethane, carbon disulfide, perfluorinated hydrocarbons such as Fluorinate® FC-40, FC-75 and FC-77, ethylacetate, dimethylformamide, diethylether, various halogenated hydrocarbons such as dichloromethane, dichloroethane and tetrachloroethylene, various aromatic hydrocarbons including, but not limited to, benzene and toluene as well as halogenated aromatics, for example halogenated benzenes or toluenes such as chloro-, dichloro- and trichloro-benzene. The absence of a disclosure of a particular nano material, or compound for the aqueous or organic phase shall not be considered as excluding use of that material or liquid and only indicates that its use has not yet been evaluated.

One skilled in the art will also recognize that numerous alternative substrates may be used such as mica, metal foils, such as aluminum or copper foils and a broad range of polymeric sheet materials including, but not limited to vinyl, polyvinyl chloride, polyethylene and polyester films (such as Mylar®). The absence of a disclosure of a particular substrate or a surface treatment for disclosed substrate shall not be considered as excluding use of that substrate or surface treatment and only indicates that its use has not yet been evaluated. Further, while the description above discloses the use of plasma activated hydrophobic substrates, hydrophobic substrates not activated can be used with the proper selection of the organic phase. In particular, films can be grown on a hydrophobic substrate using the process disclosed if the immiscible organic liquid is a perflourinated hydrocarbon. Still further, while the use of a rectangular substrate is disclosed, the utility of the process is not limited by the geometric shape of the substrate and other shapes (squares, triangles, round or oval discs, etc. may be used including three dimension substrates such as spheres.

Further, the processing times, volumes of liquids and ratios of various components are merely representative and disclose certain currently preferred operating conditions and can be varied to optimize the process for the various liquids, nanomaterials, substrates and processing containers that may be utilized. Still further, the procedure above discloses adjustment of the aqueous solution. One skilled in the art will recognize that various different acids or bases can be used. For example, suitable acids and bases to adjust the pH include, but are not limited to, hydrochloric acid, perchloric acid, phosphoric acid, hyaluronic acid, sulfuric acid, sulfonic acids including polystyrene sulfonic acid, camphor sulfonic acid, toluene sulfonic acid, dodecylbenzene sulfonic acid, other organic sulfates, camphoric acid, nitric acid, acetic acid, citric acid, hydrazine and various hydroxyl compounds such as ammonium, sodium, calcium, lithium and potassium hydroxide. The absence of a disclosure of a particular acid or base used to adjust the pH shall not be considered as excluding use of that material and only indicates that its use has not yet been evaluated.

We claim:

1. A method for forming a film of a nanomaterial comprising:

in a container, preparing a mixture of an aqueous liquid, an immiscible organic liquid and the nanomaterial, wherein the nanomaterial is a polyaniline nanofiber, a polythiophene nanofiber, or a mixture thereof, and the immiscible organic liquid is a halogenated benzene, a halogenated alkane, nitromethane, carbon disulfide, carbon tetra-chloride, tetrachloroethylene, a perfluorocarbon, or a mixture thereof, forming an emulsion of said mixture, placing a substrate within the emulsion, allowing the emulsion to separate forming an interface between an aqueous liquid phase and an organic liquid phase, the substrate being positioned within the emulsion and intersecting the forming interface, wherein the nanomaterial deposits on and spreads along the substrate surface as the emulsion separates to form a wet film on the substrate surface, and immersing the wet film in an aqueous liquid to provide a contiguous nanomaterial film separated from the substrate, or drying the wet film on the substrate surface to provide a nanomaterial film coating on the substrate.

2. The process of claim 1 wherein the emulsion is formed by vigorously mixing the mixture, said mixing comprising shaking the mixture, exposing the mixture to ultrasonic energy or using a combination of shaking and ultrasonic energy.

3. The process of claim 2 wherein the mixing or exposure to ultrasonic energy is for at least about 30 seconds.

4. The method of claim 1 wherein the nanomaterial is a doped polyaniline nanofiber, a poly (3-hexylthiophene) nanofiber, a poly (3,4-ethylenedioxythiophene) nanofiber, or a mixture thereof.

5. The method of claim 1 wherein the immiscible organic liquid is carbon tetrachloride, chloroform, methylene chloride, a perfluorocarbon, tetrachloroethylene or a mixture thereof.

6. The method of claim 1 wherein the substrate is glass, ITO coated glass, silicon, silicon dioxide, quartz, mica, a metal foil or a plastic substrate.

7. The method of claim 6 wherein the plastic substrate comprises ITO-polyethylene terephthalate, vinyl, polyvinylchloride, polyester, or polyethylene.

8. The method of claim 6 wherein the surface of the substrate is hydrophobic and the organic liquid is a perfluorocarbon.

9. The method of claim 1 wherein the surface of the substrate is hydrophilic.

10. The method of claim 1 wherein the surface of the substrate is activated to render it hydrophilic.

11. The method of claim 10 wherein the surface of the substrate is hydrophobic and it is activated by exposure to an argon-oxygen plasma.

12. The method of claim 1 wherein the surface of the substrate is hydrophobic and the nanomaterial is deposited from a binary mixture of immiscible solvents of opposing polarity.

13. The method of claim 1 wherein the film formed on the substrate is colored by addition of colored additives or reactants that color the film.

14. The method of claim 1 wherein the nanomaterial is hydrochloric acid doped, toluene sulfonic acid doped, polystyrene sulfonic acid doped, perchloric acid doped, camphor sulfonic acid doped or dedoped polyaniline nanofibers or chloride doped polythiophene nanofibers.

15. The method of claim 1 wherein the film on the substrate is dried under atmospheric ambient conditions for at least about 5 minutes.

16. The method of claim 15 wherein the film is first dried in a vapor phase above the immiscible organic liquid in the container prior to drying under atmospheric ambient conditions.

17. The method of claim 15 wherein the film on the substrate is dried under atmospheric ambient conditions for up to about 2 hours.

18. The method of claim 1 where the substrate is rectangular in shape having two long edges and two short edges, the long edges being parallel to the forming interface and on opposite sides of the forming interface.

19. The method of claim 1 wherein the aqueous liquid is water, pH adjusted aqueous solution, an aqueous acetonitrile solution, hydrazine or an alcohol solution.

20. The method of claim 19 wherein the pH is adjusted using hydrochloric acid, perchloric acid, sulfuric acid, polystyrene sulfonic acid, camphoric acid, camphor sulfonic acid, toluene sulfonic acid, dodecylbenzene sulfonic acid, nitric acid, acetic acid, citric acid, phosphoric acid, hyaluronic acid, ammonium hydroxide, hydrazine, sodium, calcium, potassium or lithium hydroxide or sodium bicarbonate.

21. The method of claim 1 wherein the organic phase has a larger volume then the aqueous phase.

22. The method of claim 21 wherein the aqueous phase is from about 0.2 to about 5 ml and the organic phase is from about 5 ml to about 30 ml.

23. The method of claim 21 wherein the organic phase has a volume from about 3 to about 20 times the aqueous phase volume.

24. The method of claim 21 wherein the organic phase has a volume from 10 times to about 20 times the aqueous phase volume.

25. A method for forming a film of a nanomaterial consisting essentially of:

in a container, preparing a mixture of an aqueous liquid, an immiscible organic liquid and the nanomaterial, wherein the nanomaterial is a polyaniline nanofiber, or a polythiophene nanofiber, or mixtures thereof, and the immiscible organic liquid is a halogenated benzene, a halogenated alkane, nitromethane, carbon disulfide, or mixtures thereof, forming an emulsion of said mixture, placing a substrate within the emulsion, allowing the emulsion to separate forming an interface between an aqueous liquid phase and an organic liquid phase, the substrate being positioned within the emulsion and intersecting the forming interface, wherein the nanomaterial deposits on and spreads along the substrate surface as the emulsion separates to form a wet film on the substrate surface, and immersing the wet film in an aqueous liquid to provide a contiguous nanomaterial film separated from the substrate, or drying the wet film on the substrate surface to provide a nanomaterial film coating on the substrate.

* * * * *